United States Patent [19]

Kitaguchi et al.

[11] Patent Number: 4,639,408

[45] Date of Patent: Jan. 27, 1987

[54] PROCESS FOR IMAGE FORMATION COMPRISING A HEATING STEP

[75] Inventors: Hiroshi Kitaguchi; Masatoshi Kato, both of Kanagawa, Japan

[73] Assignee: Fuji Photo Film Co., Ltd., Kanagawa, Japan

[21] Appl. No.: 799,996

[22] Filed: Nov. 20, 1985

[30] Foreign Application Priority Data

Nov. 21, 1984 [JP] Japan ..... 59-246468

[51] Int. Cl.[4] ..... G03C 1/40; G03C 5/54; G03C 1/06; G03C 1/42

[52] U.S. Cl. ..... 430/351; 430/203; 430/353; 430/559; 430/566; 430/598; 430/611; 430/617; 430/619; 430/955; 430/957; 430/958; 430/959

[58] Field of Search ..... 430/203, 617, 619, 443, 430/544, 957, 611, 955, 958, 959, 960, 566, 598, 559, 543, 351, 353

[56] References Cited

U.S. PATENT DOCUMENTS

| | | | |
|---|---|---|---|
| 3,674,478 | 7/1972 | Grasshoff et al. | 430/957 |
| 4,343,893 | 8/1982 | Donald et al. | 430/955 |
| 4,416,977 | 11/1983 | Ohashi et al. | 430/611 |

FOREIGN PATENT DOCUMENTS

| | | | |
|---|---|---|---|
| 58-1139 | 1/1983 | Japan | 430/955 |

*Primary Examiner*—Richard L. Schilling
*Attorney, Agent, or Firm*—Sughrue, Mion, Zinn, Macpeak & Seas

[57] ABSTRACT

A process for forming an image comprising a heating step is described, wherein a photographic material is heated in the presence of a compound represented by formula (I)

(I)

wherein X represents an atomic group completing a carbocyclic aromatic ring or a heterocyclic aromatic ring; $R^1$ is selected from groups represented by formulae (A), (B), and (C)

(A)

(B)

(C)

in which $R^{11}$ and $R^{12}$ each represents a substituted or unsubstituted alkyl group, a cycloalkyl group, a substituted or unsubstituted alkenyl group, an aralkyl group, a substituted or unsubstituted aryl group, a substituted or unsubstituted heterocyclic group, an alkyloxy or aryloxy group, an alkylthio or arylthio group, or a substituted or unsubstituted amino group, or $R^{11}$ and $R^{12}$ together form a 5-membered or 6-membered ring; $R^2$ represents a group selected from the groups represented by $R^{11}$; $R^1$ and $R^2$ together form a 5-membered or 6-membered ring; Q represents a hydrogen atom, an alkyl group, or an aryl group; TIME represents a timing group; PUG represents a photographically useful group; and n represents 0 or an integer.

12 Claims, No Drawings

PROCESS FOR IMAGE FORMATION COMPRISING A HEATING STEP

FIELD OF THE INVENTION

This invention relates to a process for forming an image comprising a heating step, and more specifically, to a process for forming an image comprising a step of heating a photographic material in the presence of a precursor for a photographically useful reagent.

BACKGROUND OF THE INVENTION

Photographic processes using silver halide have been in most widespread use because they give better photographic properties, such as sensitivity or gradation, than other photographic processes such as electrophotography or a diazo photographic process. In recent years, techniques that can give images easily and rapidly have been developed by changing the conventional wet treatment with a developer or the like in the formation and processing of images on photographic materials using silver halide to a dry treatment by, for example, heating.

Heat-developable photographic materials are known in the art, and the heat-developable photographic materials and processes therefor are described, for example, in *Fundamentals of Photographic Engineering* (Japanese language publication), pages 553–555 (Corona Co., 1979); Eizo Joho, page 40 (April 1978); *Nebletts Handbook of Photography and Reprography,* 7th ed. (Van Norstrand Reinhold Company), pages 32–33; U.S. Pat. Nos. 3,152,904, 3,301,678, 3,392,020, and 3,457,075; British Pat. Nos. 1,131,108 and 1,167,777, and *Research Disclosure,* RD No. 17029, June 1978, pages 9–15.

Many methods have been proposed with regard to the preparation of color images. With respect to the method of forming a color image by the coupling of an oxidation product of a developing agent with a coupler, U.S. Pat. No. 3,531,286 proposes a combination of a p-phenylenediamine reducing agent and a phenolic or active methylene coupler; U.S. Pat. No. 3,761,270, a p-aminophenol reducing agent; Belgian Pat. No. 802,519 and *Research Disclosure,* Vol. 137, September 1975, pages 31 and 32, a sulfonamidophenol reducing agent; and U.S. Pat. No. 4,021,240, a combination of a sulfonamidophenol reducing agent and a 4-equivalent coupler.

With regard to a method for forming a positive color image by the sensitized silver color bleaching process, useful dyes and the method of bleaching are described, for example, in *Research Disclosure,* RD No. 14433, April 1976, pages 30–33. *Research Disclosure,* RD No. 15227, December 1976, pages 14–15, and U.S. Pat. No. 4,235,957.

European Laid-Open Patent Publication Nos. 76,492 and 79,056 (corresponding to U.S. Pat. Nos. 4,500,626 and 4,483,914, respectively), and Japanese Patent Application (OPI) Nos. 15445/84 and 26008/83 (corresponding to U.S. Pat. No. 4,503,137) (the term "OPI" as used herein refers to a "published unexamined Japanese patent application") disclose a method for forming an image by heat-development utilizing a compound which has a dye moiety and at a high temperature, can release a mobile dye corresponding to, or inversely corresponding to, the reduction of silver halide to silver.

These heat-developable photographic materials are characterized by the fact that development is carried out by heating in a substantially water-free condition. Because of the dry processing, they have the great advantage of giving images easily and rapidly.

On the other hand, since necessary photographic reagents cannot be conveniently supplied from a developer solution, etc., all of the photographic reagents necessary for development should be included in advance in a photographic material. If the photographic reagents are added in an active form to the photographic material, they will tend to react with other components of the photographic material during storage before processing, or will decompose by the effect of heat, oxygen, etc., so that they cannot exhibit the desired performance during processing. One method for solving this problem is to block the active groups of the photographic reagents and add them in a substantially inactive form, namely, as precursors of the photographic reagents, to the photographic material.

A dye is one type of photographically useful reagent. If a functional group which greatly affects its spectral absorption is blocked to shift its spectral absorption to a shorter or longer wavelength side, the photographic material has the advantage that even when this dye is present together with a silver halide emulsion layer having a corresponding spectral sensitivity region, a decrease in sensitivity due to the so-called filter effect does not occur. If the useful photographic reagent is an antifoggant or a development restrainer, the action of such a reagent to decrease the sensitivity of the photographic material by its adsorption on the photosensitive silver halide or the formation of a silver salt during storage can be suppressed by blocking active groups thereof. By releasing these photographic reagents at required times, it is possible to reduce fogging without impairing sensitivity, inhibit overdevelopment fog, or to stop the development at a required time. If the useful photographic reagent is a developing agent, an auxiliary developing agent, or a fogging agent, blocking of active groups or adsorptive groups makes it possible to prevent various photographically deleterious actions due to the formation of semiquinone or oxidation products by air oxidation during storage, or to prevent the occurrence of a fog nucleus during storage by preventing electron injection into silver halide, and consequently to perform stable processing. If the photographic reagent is a bleach accelerator or a bleach-fixing accelerator its reaction with other components of the photographic material during storage can be inhibited by blocking its active groups. By removing the blocked groups during processing, the required performance of such reagent can be exhibited at required times.

Some techniques of blocking such photographic reagents have already been known in conventional photographic materials. For example, Japanese Patent Publication No. 44805/72 (corresponding to U.S. Pat. No. 3,615,617) utilizes blocking groups such as an acyl or sulfonyl group. Japanese Patent Publication Nos. 17369/79, 9696/80, and 34927/80 (corresponding to U.S. Pat. Nos. 3,888,677, 3,791,830 and 4,009,029, respectively) utilize blocking groups which release photographic reagents by the so-called reverse Michael reaction. Japanese Patent Publication No. 39727/79 (corresponding to U.S. Pat. Nos. 3,685,991, 3,674,478, 3,993,661 and 3,932,480), and Japanese Patent Application (OPI) Nos. 135944/82, 136945/82, and 136640/82 (corresponding to U.S. Pat. Nos. 4,416,977, 4,420,554 and 4,420,554, respectively) utilize blocking groups which release a photographic reagent by the formation of quinonemethide or quinonemethide-like compounds due to intramolecular electron transfer. Japanese Patent Application (OPI) No. 53330/80 (corresponding to U.S. Pat. Nos. 4,358,525 and 4,310,612) utilizes intramolecular cyclization reaction. Japanese Patent Application (OPI) Nos. 76541/82 (corresponding to U.S. Pat. No. 4,335,200), 135949/82 (corresponding to U.S. Pat. No. 4,350,752), and 179842/82 utilize cleavage of a 5-membered or 6-membered ring. All of these known techniques make use of hydrolysis or elimination of proton by the action of $OH^{\ominus}$ during wet development. No precursor technology has yet been known in the case of dry processing using organic bases.

SUMMARY OF THE INVENTION

An object of this invention, therefore, is to provide a process for forming an image comprising a heating step to be performed in the presence of a precursor of a photographically useful reagent.

Another object of this invention is to provide a compound which has a function of not releasing a photographically useful reagent until heat development.

Still another object of this invention is to provide a process for forming an image in a dry state which does not easily cause non-uniformity in the image even at varying developing temperatures.

The above objects of the invention are achieved by a process for forming an image in the dry state, which comprises heating a photographic material in the presence of a compound represented by formula (I)

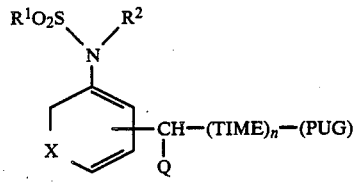

(I)

wherein X represents an atomic group comprising a carbocyclic aromatic ring or a heterocyclic aromatic ring; $R^1$ is selected from groups represented by formulae (A), (B), and (C)

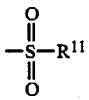

(A)

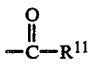

(B)

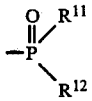

(C)

in which $R^{11}$ and $R^{12}$ (which may be identical or different) each represents a substituted or unsubstituted alkyl group, a cycloalkyl group, a substituted or unsubstituted alkenyl group, an aralkyl group, a substituted or unsubstituted aryl group, a substituted or unsubstituted heterocyclic group, an alkyloxy or aryloxy group, an alkylthio or arylthio group, or a substituted or unsubstituted amino group, or $R^{11}$ and $R^{12}$ together form a 5-membered or 6-membered ring; $R^2$ represents a group selected from the groups represented by $R^{11}$ or $R^{12}$; $R^1$ and $R^2$ together form a 5-membered or 6-membered ring; Q represents a hydrogen atom, an alkyl group, or an aryl group; TIME represents a timing group; PUG represents a photographically useful group; and n represents 0 or an integer.

DETAILED DESCRIPTION OF THE INVENTION

The alkyl groups for $R^{11}$ and $R^{12}$ are preferably linear or branched alkyl groups having from 1 to 18 carbon atoms. Specific examples include methyl, ethyl, n-propyl, n-butyl, n-hexyl, n-heptyl, 2-ethylhexyl, n-decyl and n-dodecyl groups. Examples of the substituent in the substituted alkyl group include halogen atoms, alkoxy groups, aryloxy groups, a cyano group, alkylthio or arylthio groups, a substituted or unsubstituted carbamoyl group, alkylsulfonyl or arylsulfonyl groups, amino groups disubstituted by alkyl or aryl groups, a hydroxyl group, a carboxyl group, a sulfo group, acylamino groups, and a sulfonylamino group.

The cycloalkyl group is preferably a 5-membered or 6-membered cycloalkyl group having from 5 to 10 carbon atoms. Specific examples include cyclopentyl and cyclohexyl groups.

Examples of the alkenyl group include a vinyl group, an allyl group, a crotyl group, and a substituted or unsubstituted styryl group.

Examples of the aralkyl group include a benzyl group and a $\beta$-phenethyl group.

The aryl group is preferably an aryl group having from 6 to 18 carbon atoms. Specific examples include phenyl, naphthyl, and anthryl groups. Examples of the substituent in the substituted aryl group include substituted or unsubstituted alkyl groups, substituted or unsubstituted alkoxy groups, substituted or unsubstituted aryl groups, halogen atoms, acylamino groups, a sulfonylamino group, a cyano group, a nitro group, alkylthio or arylthio group, alkylsulfonyl or arylsulfonyl groups, a carbonyloxy group, a hydroxyl group, a substituted or unsubstituted carbamoyl group, a substituted or unsubstituted sulfamoyl group, amino groups disubstituted by alkyl or aryl groups, a carboxyl group, a sulfo group, and alkyloxycarbonyl or aryloxycarbonyl groups.

The heterocyclic group is preferably a 5-membered or 6-membered heterocyclic group having oxygen, nitrogen, or sulfur as a hetero atom. Examples include pyridyl, furyl, thienyl, pyrrolyl, and indolyl groups. The heterocyclic group may have a substituent, examples of which are the groups described above as substituents for the substituted aryl groups.

Preferred examples of the alkyloxy or aryloxy group and the alkylthio or arylthio group are represented by (D) and (E) below.

$$-OR^{13} \quad \text{(D)}$$

$$-SR^{14} \quad \text{(E)}$$

Preferred examples of $R^{13}$ and $R^{14}$ are the same groups as those described above with respect to the alkyl and aryl groups represented by $R^{11}$, $R^{13}$ and $R^{14}$ may be substituted.

X represents an atomic group completing a carbocyclic aromatic ring or a heterocyclic aromatic ring. Specific, examples of the carbocyclic ring are a benzene ring and a naphthalene ring. Specific examples of the heterocyclic ring include pyridine, pyrimidine, triazine, pyrrole, imidazole, triazole, thiophene, furan, thiazole, oxazole, indole, carbazole, benzothiazole, benzimidazole, benzotriazole, benzoxazole, indazole, pyridazine, pyrazole, purine and pyrazine. Of these, the benzene ring and naphthalene ring are preferred because raw materials therefor are easy to obtain and their synthesis is also easy.

Q represents a hydrogen atom, an alkyl group, or an aryl group. Preferred examples of the alkyl group and the aryl group are those given above with regard to $R^{11}$ and $R^{12}$.

TIME represents a so-called timing group. Typical examples are groups of the formula $$-\overset{\overset{\displaystyle O}{\|}}{O}C-(PUG)$$

described in Japanese Patent Publication No. 9696/80 (corresponding to U.S. Pat. No. 3,791,830) and Japanese Patent Application (OPI) Nos. 1139/83 and 1140/83, and groups of the formula $-OCH_2-(PUG)$ described in Japanese Patent Application (OPI) No. 93442/84 (corresponding to U.S. Pat. No. 4,522,917).

Examples of the photographically useful reagents (PUG) released from the precursor compound include antifoggants, development restrainers, developing agents, development accelerators, electron donors (EDs), fogging agent, nucleus-forming agents, solvents for silver halide, bleach accelerators, bleach-fixation accelerators, fixation accelerators, dyes, colored materials for color diffusion transfer, and couplers. Specific examples of the antifoggants and development restrainers are nitrogen-containing heterocyclic compounds having a mercapto group. Examples of the developing agents and development accelerators include hydroquinones, catechols, aminophenols, p-phenylenediamines, pyrazolidones and ascorbic acids. Examples of the electron donors, foggants and nucleus-forming agents include α-hydroxyketones, α-sulfonamidoketones, hydrazines, hydrazides, tetrasolium salts, aldehydes, acetylenes, quaternary salts, and isodo. Examples of the solvents for silver halide are thioethers, rhodanines, sodium thiosulfate, and methylene bissulfones. Examples of the bleach accelerators and bleach-fixation accelerators include aminoethanolthiols, sulfoethanethiols and aminoethanethiocarbamates. An example of the fixation accelerator is hypo (sodium thiosulfate). Examples of the dyes include azo dyes, azomethine dyes, anthraquinone dyes, and indophenol dyes.

In the process for forming an image according to this invention, which comprises a heating step, it is preferred to use photographic materials known as the heat-developable photographic materials (for example, those described in the prior art literatures). The compound of formula (I) may be included in any layer (such as a photosensitive layer, an interlayer, or a protective layer) present on a support forming the heat-developable photographic material. When an image-receiving layer is provided on another support, it may be included in any layer on this support.

The heat-developable photographic materials are most preferably those containing silver halide as a light-sensitive element.

The suitable heating temperature is generally from about 80° C. to about 250° C., and preferably is from 110° to 180° C.

It is the development restrainers which exhibit the most remarkable effect among the above photographically useful reagents when blocked as a compound in the form of formula (I). Restrainers which exhibit especially great effects are represented by formula (II)

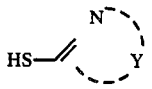

(II)

wherein Y represents an atomic group forming a 5-membered or 6-membered heterocyclic ring (preferably containing a sulfur, nitrogen, or oxygen atom within the ring).

In formula (II), the block group is bonded at the sulfur or nitrogen atom.

Preferred examples of the development restrainers of formula (II) are shown below.

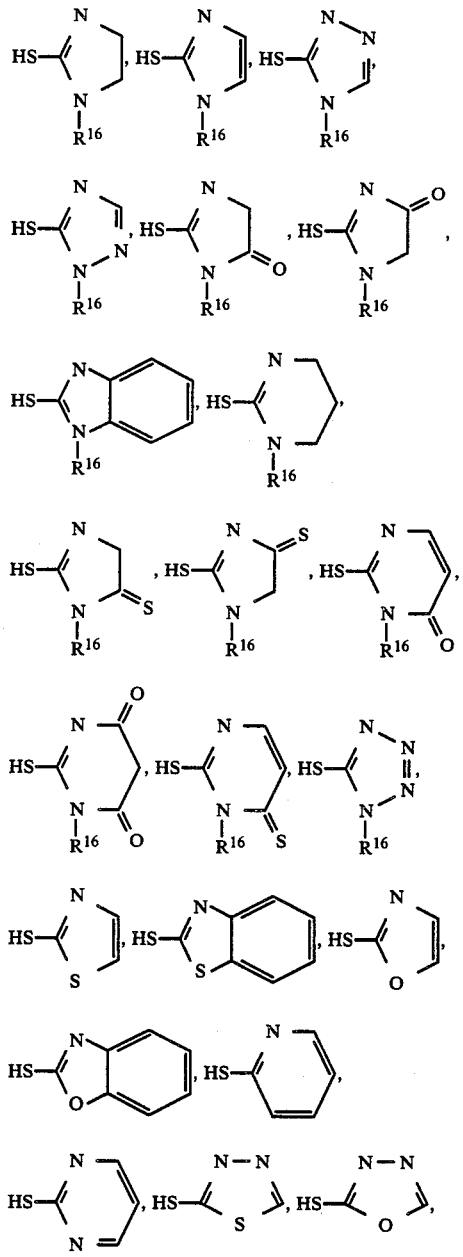

-continued

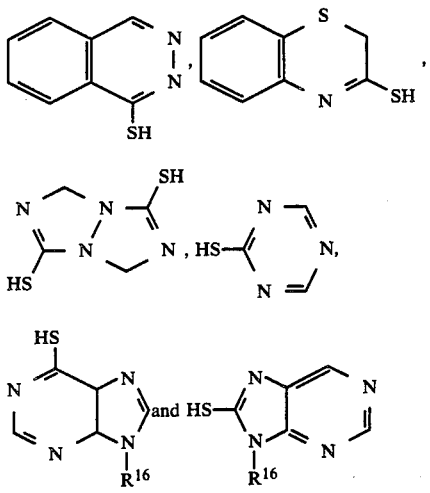

In the above formulae, $R^{16}$ represents a group selected from a hydrogen atom, alkyl groups, aryl groups, cycloalkyl groups, alkenyl groups, and aralkyl groups. These groups may have suitable substituents. Typical examples of the substituents are the substituents allowed for $R^{11}$. The carbon atoms forming the above ring structure may be substituted by other substituents instead of a hydrogen atom. Typical examples of the substituents are the substituents allowed for the aforesaid benzene or naphthalene ring.

It is known that the nitrogen-containing heterocyclic compounds of formula (II) containing a mercapto group have an effect of restraining development in silver halide photographic materials. With regard to heat-developable photographic materials, it is described, for example, in Japanese Patent Application No. 176351/84. If the compound of formula (II) is present in the emulsion layer from the start, the development is restrained at the early stage of development so that the density of the image is reduced and the photographic material has low sensitivity. However, since the compound of formula (I) used in this invention gradually releases the development restrainer (II) during heat-development, the development can be appropriately stopped without reducing the density of the image.

By including the compound (I) of this invention in which the development restrainer (II) is blocked, it is possible to obtain a heat-developable photographic material having the ability to compensate for non-uniformity in developing temperature. Since the development is usually carried out at a high temperature of more than 100° C., slight temperature non-uniformity cannot be avoided. In a part kept at a higher temperature, the attained density of the image is high, whereas in part kept at a lower temperature, it is low. Hence, non-uniformity in the density of the image, especially in the fog density of a non-image area, occurs as a whole. The inclusion of the compound (I) of this invention has led to the successful reduction of the non-uniformity in image density as a whole because at the high-temperature part, the amount of the development restrainer (II) released is large and the attained density of the image is controlled to a lower level.

It is believed that during heat-development, the compound (I) of this invention is subjected to the action of a nucleophilic agent to form an anion (III) of sulfonanilide, and by intramolecular electron transfer, it releases a PUG (or its dissociated product).

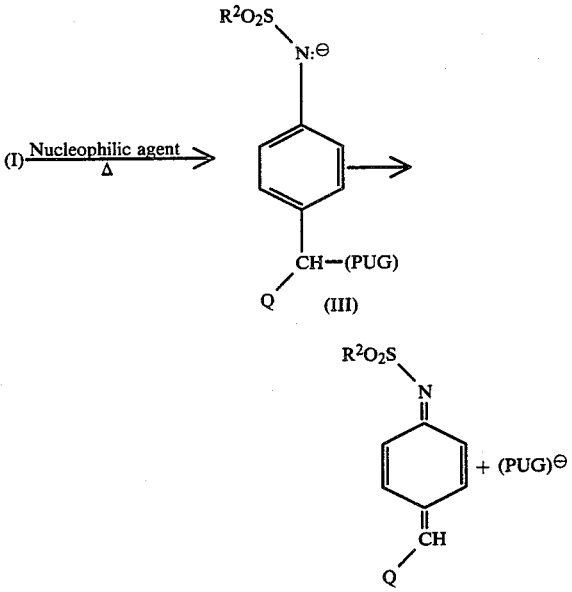

Japanese Patent Application (OPI) No. 1139/83 describes an example of using a compound according to formula (I) of this invention in which $R^1$ is a hydrogen atom as a precursor. This utilizes the fact that during wet development, a dissociated species forms by the action of $OH^{\ominus}$. However, this technique has the defect that the storage stability of the resulting image is poor. The present invention, however, can overcome this defect, since the PUG is released after the compound (I) of this invention undergoes nucleophilic attack during treatment at a high temperature and $R^1$ is converted into a hydrogen atom. For the conversion of the group

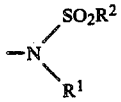

into the group $—NHSO_2R^2$, it is generally necessary to assume attacking of some nucleophilic reagent. It is not clear what this nucleophilic reagent is. However, for example, it is possible to assume various terminal residues of amino acids constituting gelatin forming the binder, such as $—NH_2$, —OH, $—CO_2H$, —SH, or

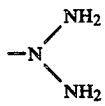

as the nucleophilic reagent. The reaction of the compound of formula (I) with such terminal residues is very slow at ordinary temperatures, but is accelerated at higher temperatures such as those at which the heat-developable photographic material is processed. Presumably, this makes it possible to release the PUG.

When a base or a base precursor is used as the development accelerator, the base acts as a nucleophilic reagent during heat-development and accelerates the releasing of the PUG. Hence, the combined use of the base or base precursor and the compound (I) of this invention is particularly advantageous.

It can be anticipated that the reaction of the compound of formula (I) of this invention with the nucleophilic reagent will take place in solution. However, the present inventors have unexpectedly found that in a dry film, a similar reaction can take place effectively within a short period of time during heat development.

Specific examples of the compound of this invention represented by formula (I) are set forth below, without limiting the present invention thereby.

(1)

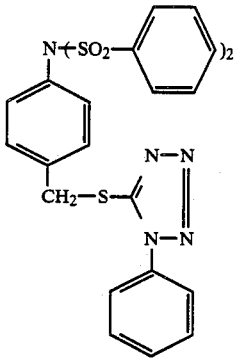

(2)

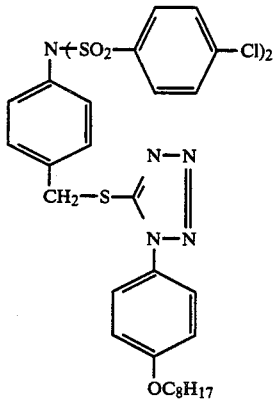

(3)

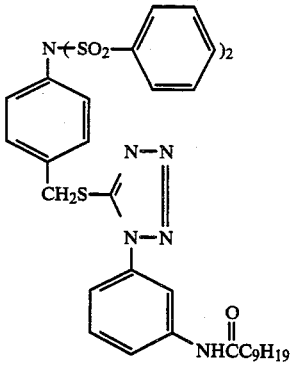

(4)

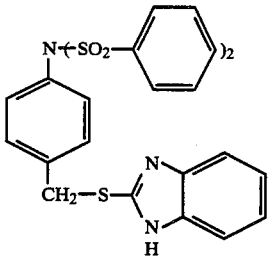

(5)

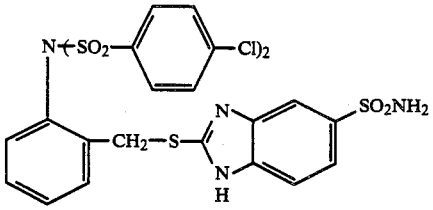

(6)

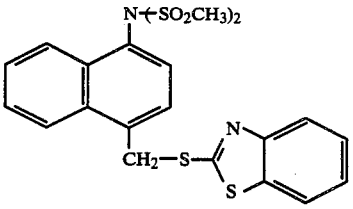

(7)

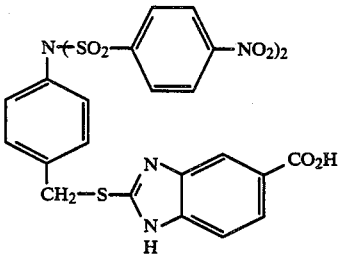

(8)

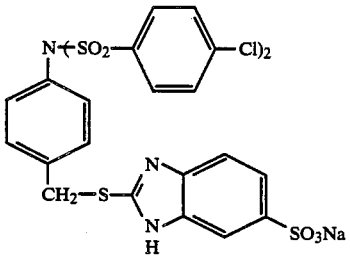

-continued
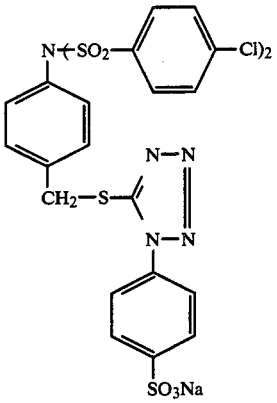
(9)
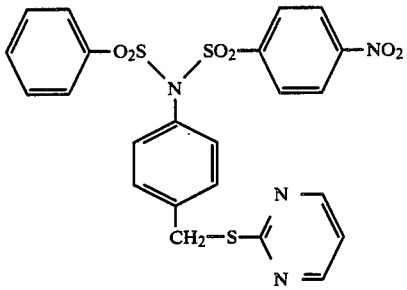
(10)
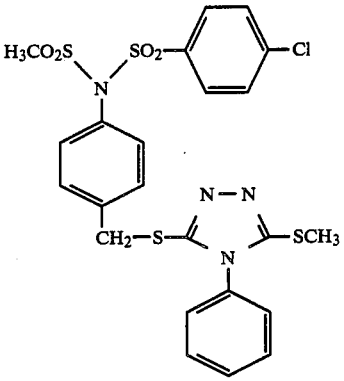
(11)
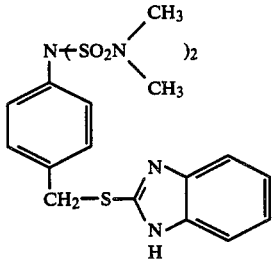
(12)
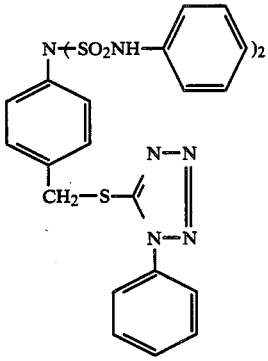
(13)
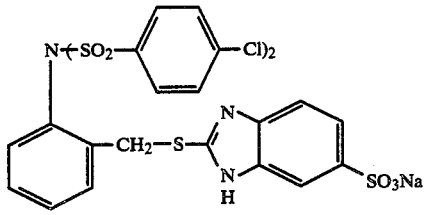
(14)
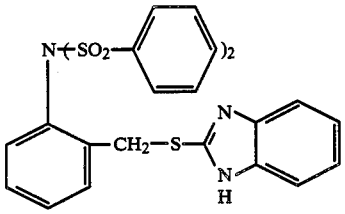
(15)
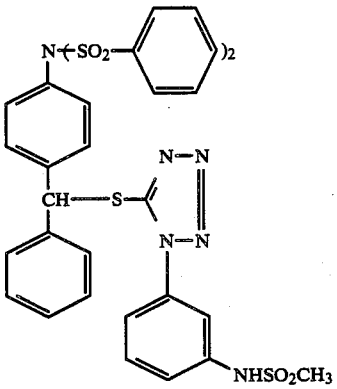
(16)

-continued
(17)
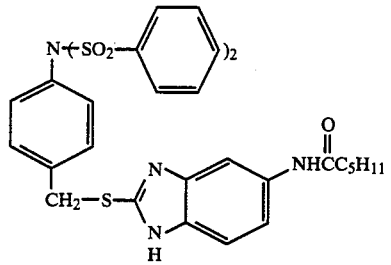
(18)
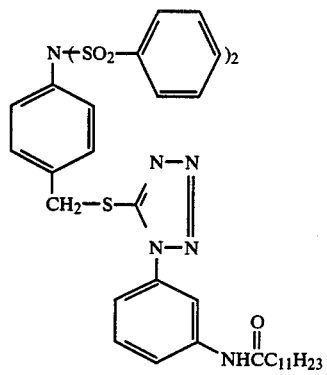
(19)
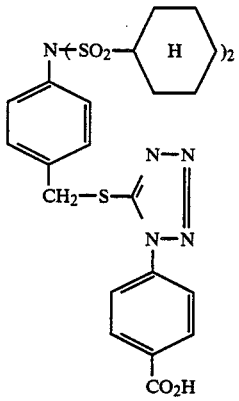
(20)
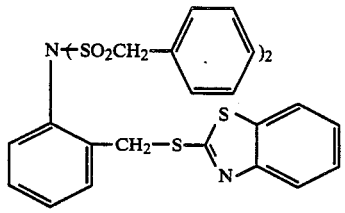
(21)
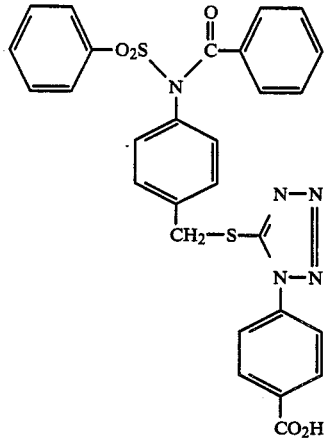
(22)
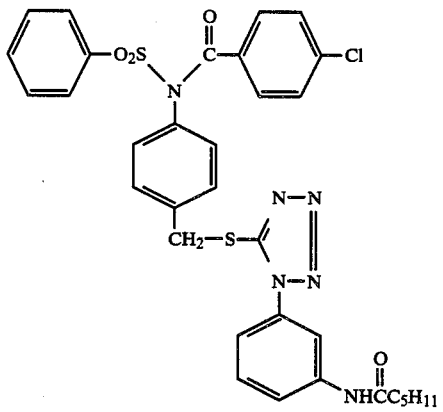
(23)
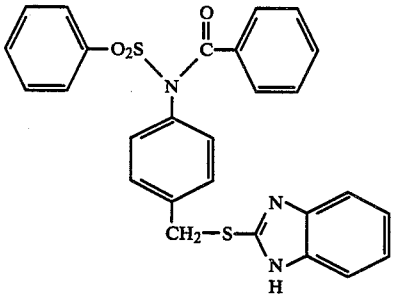
(24)
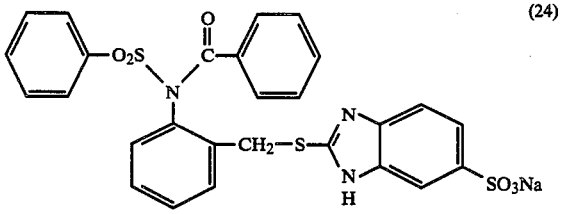

-continued
(25)
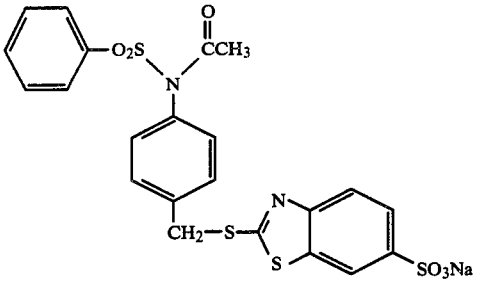
(26)
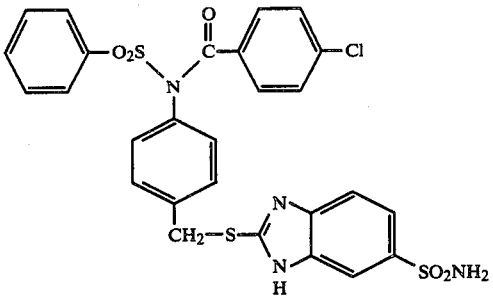
(27)
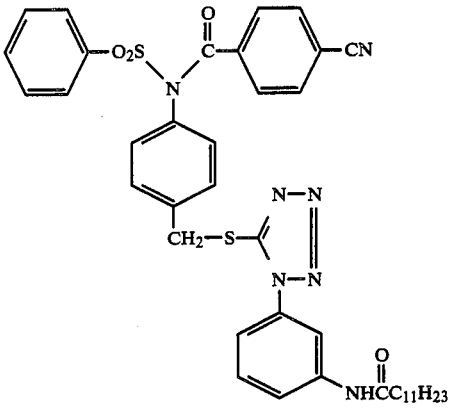
(28)
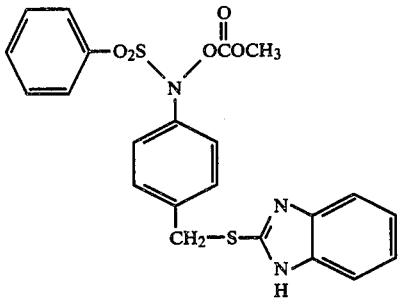
(29)
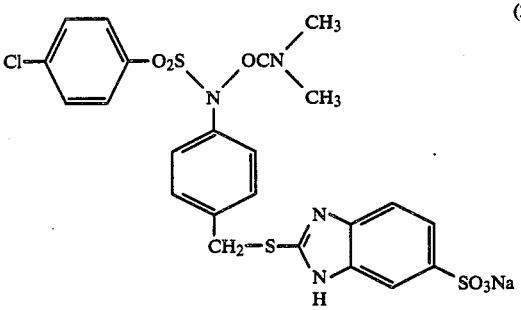
(30)
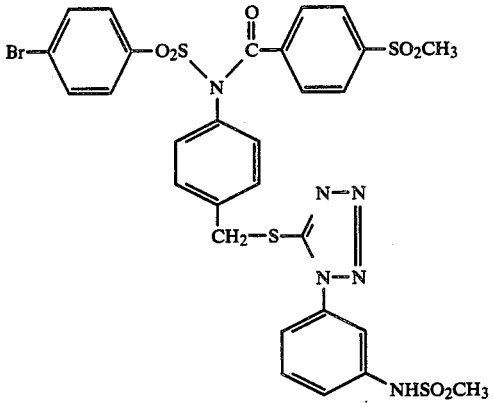
(31)
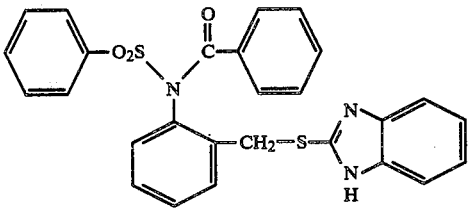
(32)
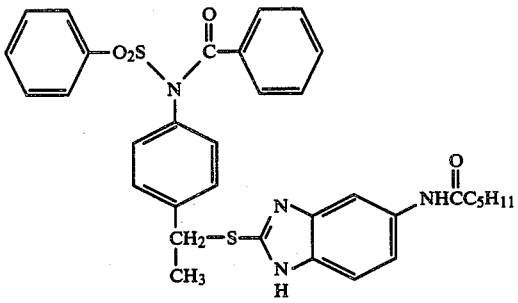

-continued
(33)
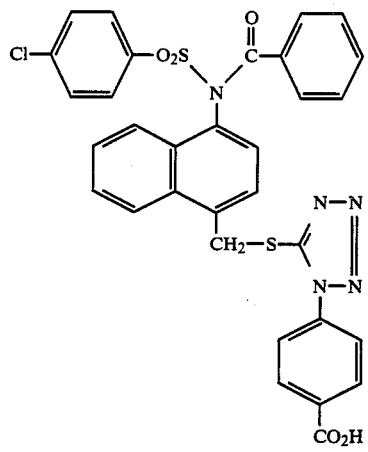
(34)
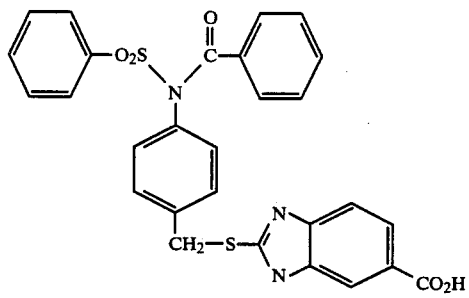
(35)
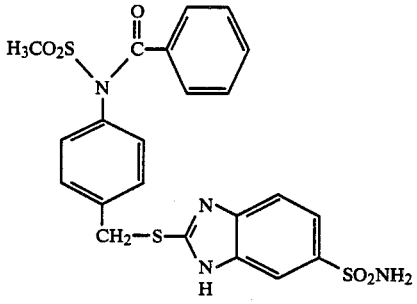
(36)
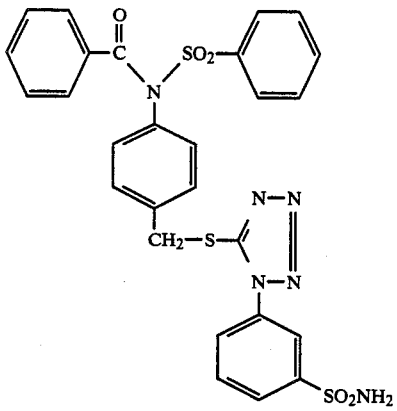
(37)
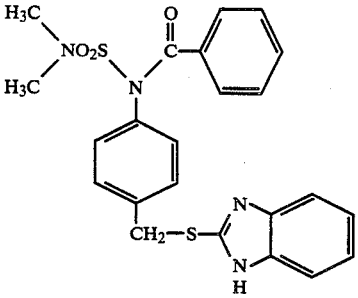
(38)
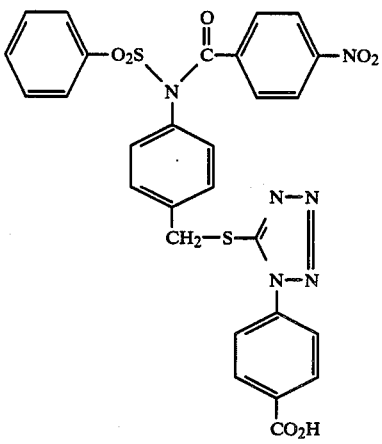
(39)
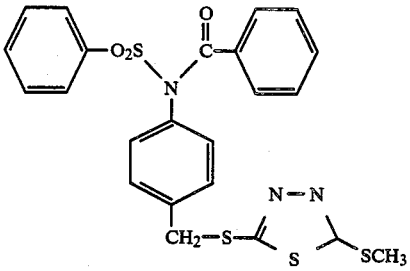
(40)
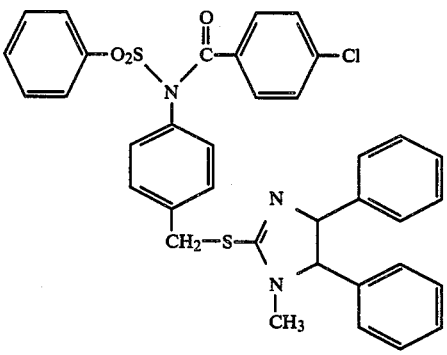

-continued
(41)
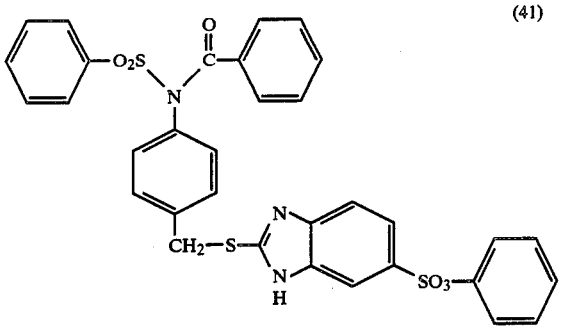
(42)
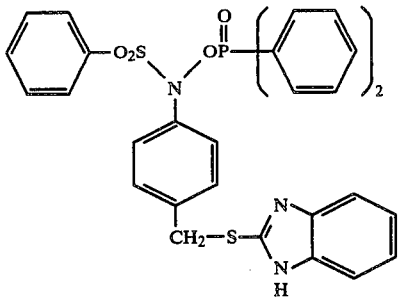
(43)
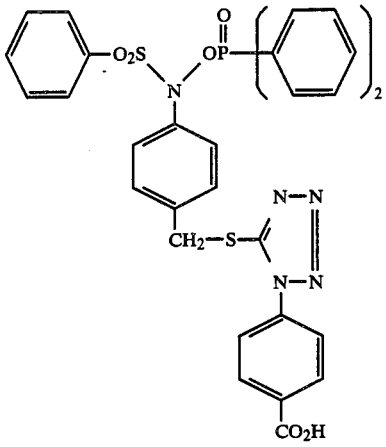
(44)
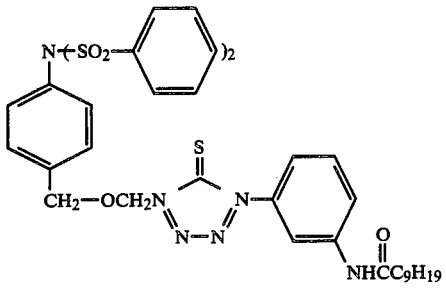
(45)
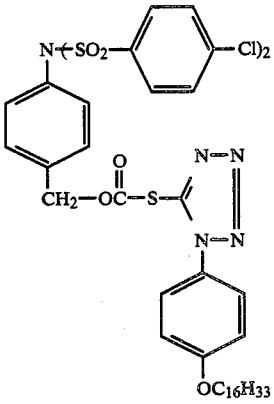
(46)
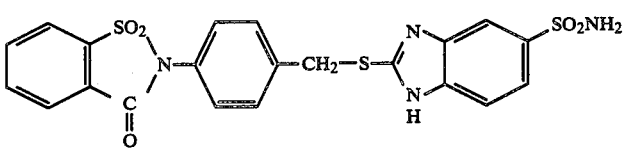

-continued
(47)
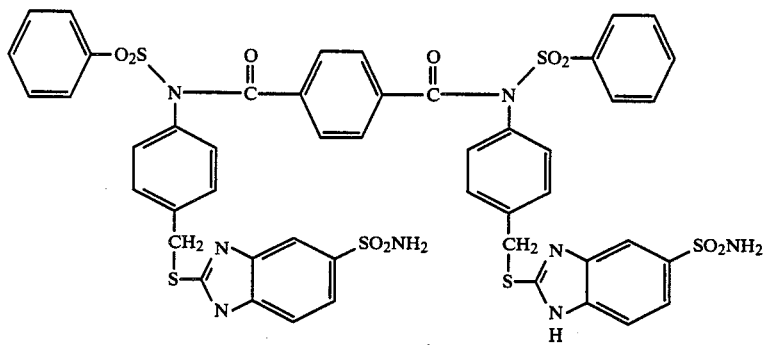
(48)
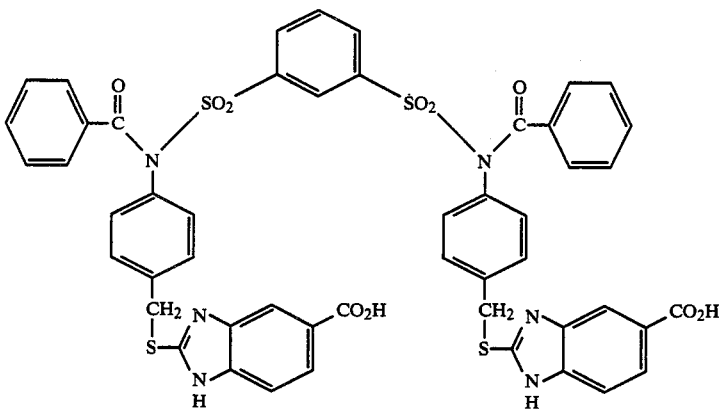
(49)
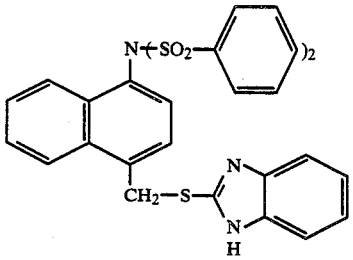
(50)
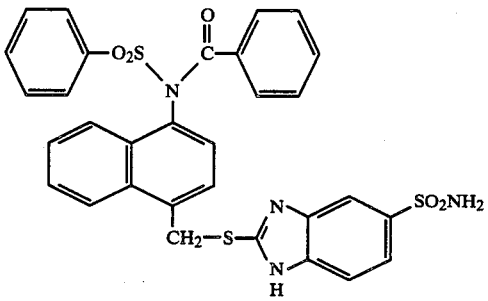
(51)
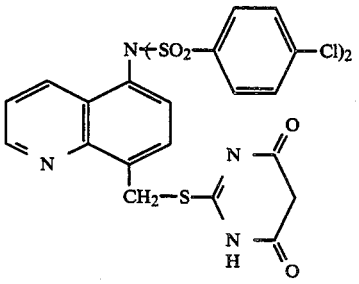
(52)
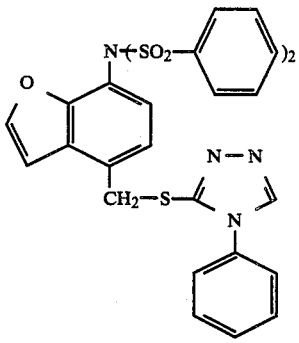

-continued
(53)
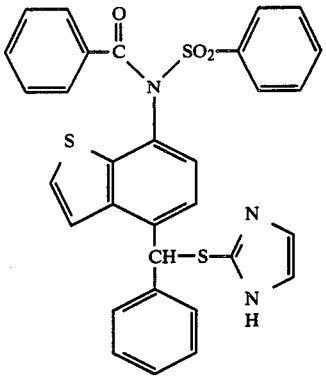
(54)
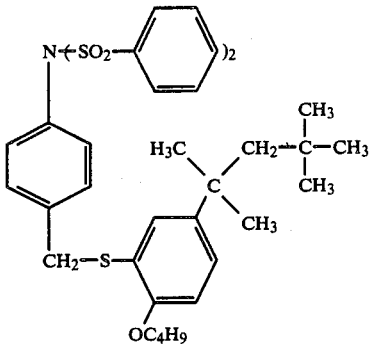
(55)
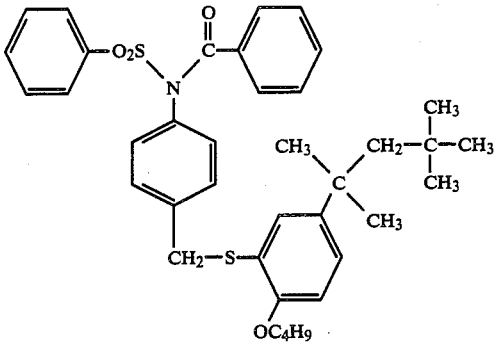
(56)
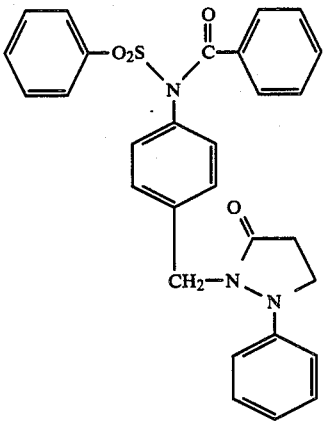
(57)
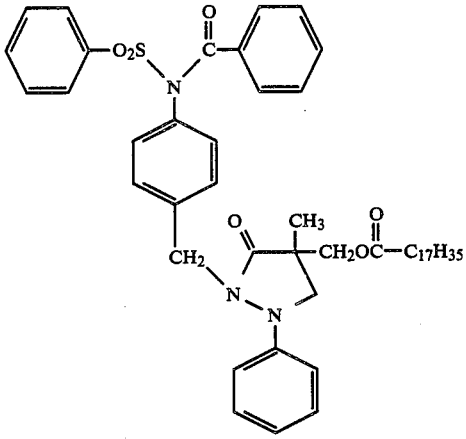
(58)
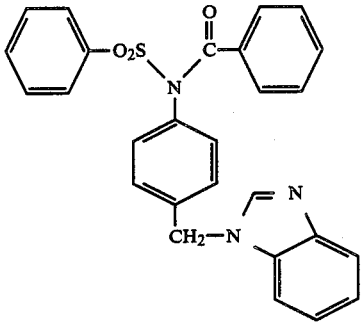
(59)
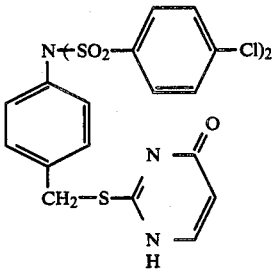
(60)
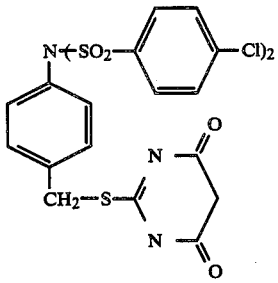

-continued
(61)
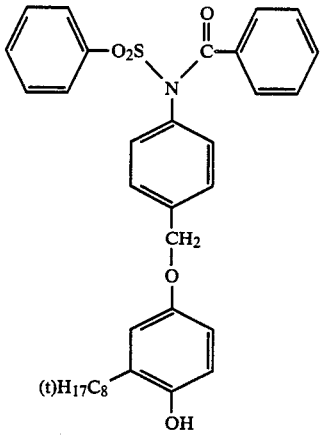
(62)
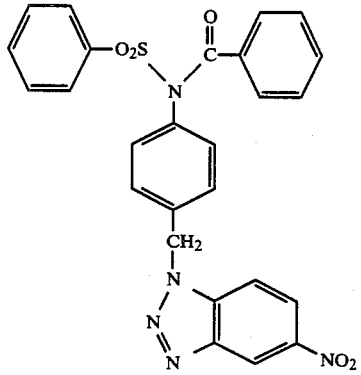
(63)
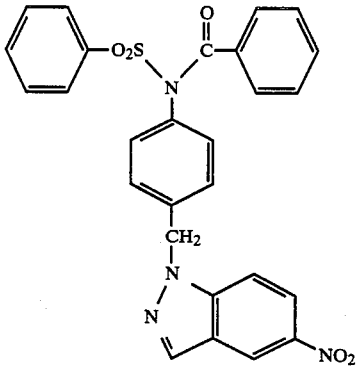
(64)
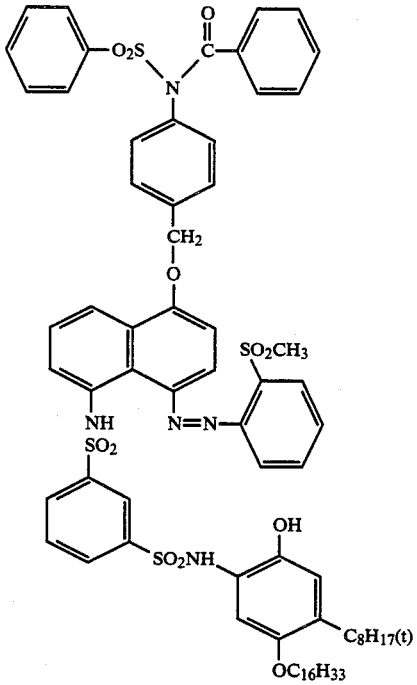
(65)
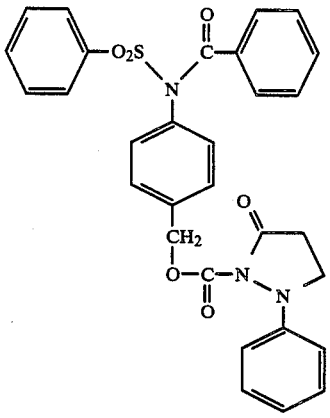
(66)
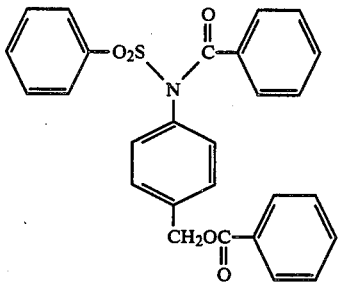
A method of synthesizing the compounds (I) of this invention will now be described.
The compound (I) of this invention in which X forms a benzene ring and Q is a hydrogen can be synthesized, e.g., through the following route using o- or p-toluidine as a raw material.

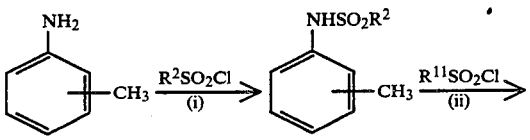

(o- or p-form)

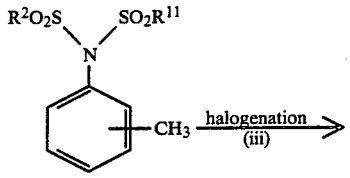

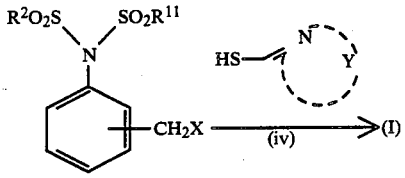

(X represents a halogen atom).

When in step (ii) $R^{11}COCl$ or

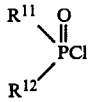

is used instead of $R^{11}SO_2Cl$, a compound of formula (I) in which $—R^1$ is represented by (B) or (C) can also be synthesized.

The condensation reaction in step (i) is desirably carried out in the presence of a deoxidizer, for example, an organic base such as pyridine.

The condensation reaction in step (ii) is desirably carried out by converting sulfonanilide into a dissociated product by using an organic base having a pKa of at least 10, such as triethylamine, an inorganic base such as sodium hydroxide or potassium hydroxide, a metal alcoholate such as sodium methylate or a metal hydride such as sodium hydride.

Halogenation of the side chain in step (ii) is carried out by using chlorine, sulfuryl chloride, bromine, N-chlorosuccinimide, N-bromosuccinimide, etc. Preferably, a radical initiator such as benzoyl peroxide (BPO) or azobisisobutyronitrile (AIBN) are used in this step. Light irradiation is frequently effective.

The condensation in step (iii) is preferably carried out using an organic base such as triethylamine or an inorganic base such as potassium carbonate. The reaction proceeds smoothly if a sodium salt of thiol is prepared in advance.

Examples of synthesizing the compounds of formula (I) are set forth below.

SYNTHESIS EXAMPLE 1

Synthesis of Compound (4)

(1) Synthesis of N-benzenesulfonyl-p-toludine

Two hundred milliliter of acetonitrile solution of 32.1 g (0.3 mole) of p-toluidine and 26 ml (0.32 mole) of pyridine was stirred at a temperature of less than 25° C., and 54.7 g (0.31 mole) of benzenesulfonyl chloride was added dropwise to the solution. After the addition, the mixture was further stirred for 1 hour, and then the reaction mixture was added to 1 liter of water. The precipitate was extracted with ethyl acetate. The ethyl acetate layer was washed with an aqueous solution of sodium chloride, and dried over anhydrous sodium sulfate. Ethyl acetate was evaporated under reduced pressure to give 74.3 g (0.3 mole) of the captioned compound. This compound was used in the next step without purification.

(2) Synthesis of N,N-dibenzenesulfonyl-p-toludine

A solution composed of 74.3 g of the resulting N-benzenesulfonyl-p-toludine, 13 g (0.3 mole) of 93% sodium hydroxide, 300 ml of water and 200 ml of acetonitrile was heated to 50° C., and the stirring, 84.7 g (0.48 mole) of benzenesulfonyl chloride was added dropwise to the solution. In the latter half of the addition, the pH of the reaction mixture reached a neutral point or less. Hence, a 3N aqueous solution of sodium hydroxide was added so as to maintain the pH of the reaction mixture always at 10 or higher. When the decrease in pH was no longer observed, the reaction mixture was neutralized with hydrochloric acid and cooled to 20° C. The precipitate was collected by filtration, and washed with water. The crystals obtained contained some oil, but by washing it out with methanol, 93.4 g (0.24 mole) of the captioned compound was obtained as a pure product.

(3) Synthesis of N,N-dibenzenesulfonyl-p-bromomethylaniline 46.4 g (0.12 mole) of the resulting toludine, 17.8 g (0.1 mole) of N-bromosuccinimide and 500 ml of a carbon tetrachloride solution containing a small amount of benzoyl peroxide as a radical initiator were refluxed for 1 hour under light irradiation. After the reaction, the precipitated crystals of succinimide was separated by hot filtration. The mother liquor was distilled under reduced pressure. Distillation was stopped when the amount of the mother liquor became about 200 ml, and 200 ml of ethyl acetate and 40 ml of n-hexane was added. The mixture was cooled, and the precipitated crystals were collected by filtration, washed with a mixed solvent of ethyl acetate and methanol to give 29.7 g (0.064 mole) of the captioned compound.

(4) Synthesis of compound (4)

Three hundred milliliters of an acetone solution containing 28 g (0.06 mole) of the resulting bromomethyl compound, 9 g (0.06 mole) of 2-mercaptobenzimidazole and 8.3 g of anhydrous potassium carbonate was refluxed for 1 hour. After the reaction, the reaction mixture was cooled with ice, and the precipitate was collected by filtration. The resulting crystals were washed with warm water to remove inorganic salts and dried. The dried crystals were dissolved in a mixed solvent of 600 ml of chloroform and 200 ml of ethanol under heat, and the insoluble materials were separated by filtration. The solution was concentrated under reduced pressure until its amount became about one-third of the original amount. Then, 200 ml of methanol was added. The precipitated crystals were collected and washed with methanol to give 21.1 g (0.039 mole) of compound (4). Melting point 206°-207° C.

SYNTHESIS EXAMPLE 2

Synthesis of Compound (23)

(1) Synthesis of N-benzenesulfonyl-N-benzoyl-p-toluidine 250 ml of an acetonitrile solution containing 60 g (0.24 mole) of N-benzenesulfonyl-p-toluidine synthesized by the same method as in Synthesis Example 1 and 37 ml (0.27 mole) of triethylamine was cooled to below 10° C. and while maintaining this temperature, 35.8 g (0.26 mole) of benzoyl chloride was added dropwise. After the addition, the mixture was further reacted at room temperature for 30 minutes. The reaction mixture was then added to 1 liter of water. The precipitate was collected by filtration, washed with water and then with methanol to give 80.8 g (0.23 mole) of the captioned compound.

(2) Synthesis of N-benzenesulfonyl-N-benzoyl-p-bromomethylaniline 700 ml of a carbon tetrachloride solution containing 70.2 g (0.2 mole) of toludine, 28.5 g (0.16 mole) of N-bromosuccinimide and a small amount of benzoyl peroxide as a radical initiator was refluxed for 1 hour under light irradiation. After the refluxing, the precipitated crystals of succinimide were separated by hot filtration, and the mother liquor was distilled under reduced pressure. To the residue were added 200 ml of n-hexane, 100 ml of ethyl acetate and 100 ml of ethanol, and the mixture was left to stand overnight. The precipitated crystals were collected by filtration, and washed with a mixed solvent of n-hexane and ethanol (v/v=1/1) to give 54.9 g (0.128 mole) of the captioned compound.

(3) Synthesis of compound (23)

600 ml of an acetone solution containing 54.9 g (0.128 mole) of the resulting bromomethyl compound, 19.2 g (0.128 mole) of 2-mercaptoimidazole and 17.7 g (0.128 mole) of anhydrous potassium carbonate was refluxed for 1 hour. After the reaction, the precipitated inorganic salt was removed by hot filtration, and the filtrate was distilled under reduced pressure. Chloroform was added to the tarry residue, and the mixture was stirred, whereupon the unreacted 2-mercaptoimidazole was precipitated. The precipitate was separated by filtration. Chloroform was evaporated from the filtrate under reduced pressure, and the residue was recrystallized from methanol. The resulting crystals were recrystallized from a mixed solvent of chloroform and ethyl acetate (v/v=5/1) to give 16.6 g (0.0332 mole) of compound (23). Melting point 183°-185° C.

SYNTHESIS EXAMPLE 3

Synthesis of Compound (18)

Eighty milliliters of methanol solution containing 10.43 g (0.03 mole) of 1-(m-lauroylaminophenyl)-5-mercaptotetrazole, and 5.79 g (0.03 mole) of sodium methylate as a 28% methanol solution was stirred at room temperature, and 14 g (0.03 mole) of N,N-dibenzenesulfonyl-p-bromomethylaniline synthesized in Synthesis Example 1 was added little by little to the solution. After the addition, the mixture was stirred at room temperature for 30 minutes, and further refluxed for 5 minutes with stirring. The reaction mixture was cooled with ice, and the precipitated crystals were collected by filtration.

The crude crystals were recrystallized from a mixed solvent of methanol and ethanol (v/v=1/1) to give 17.2 g (0.0227 mole) of the captioned compound.

Yield: 76%.

Melting point 129°-131° C.

The silver halide that can be used in this invention may be any of silver chloride, silver bromide, silver iodide, silver chlorobromide, silver chloroiodide, silver iodobromide and silver chloroiodobromide. The proportion of halogen in the silver halide grains may be uniform, or they may be of a multiple structure in which the proportion of halogen differs between the surface layer and the interior (Japanese Patent Application (OPI) Nos. 154232/82, 10853/83, 48755/84 and 52237/84, U.S. Pat. No. 4,433,048, and European Patent No. 100,984). Plate-like grains having a thickness of not more than 0.5 μm, a diameter of at least 0.6 μm, and an average aspect ratio of at least 5 (U.S. Pat. Nos. 4,435,499 and 4,414,310, and West German OLS No. 3,241,646A1), and monodisperse emulsions having a nearly uniform grain size distribution (Japanese Patent Application (OPI) Nos. 178235/82, 100846/83, and 14829/83, International Laid-Open Patent Application 83/02338A1, and European Patent Nos. 64,412A3 and 83,377A1) can also be used in this invention. Two or more kinds of silver halides having different crystal habits, halogen proportions, grain sizes, grain size distributions, etc. may be used in combination. The gradation may be adjusted by mixing at least two monodisperse emulsions having different grain sizes.

The silver halide used in this invention has an average grain size of preferably from 0.001 μm to 10 μm, and more preferably from 0.001 μm to 5 μm. These silver halide emulsions may be prepared by any of the acidic method, the neutral method, or the ammonia method. The type of reaction between a soluble silver salt and a soluble halogen salt may be a one side mixing method, a simultaneous mixing method, or a combination thereof. A reverse mixing method in which the grains are formed in the presence of an excess of a silver ion, or a controlled double jet method in which pAg is maintained constant can also be used. To quicken the grain growth, the concentrations of the silver salt and halogen salt added, the amounts of these compounds added, or the rate of adding these compounds may be increased (Japanese Patent Application (OPI) Nos. 142329/80 and 158124/80 and U.S. Pat. No. 3,650,757).

Epitaxially coalesced silver halide grains may also be used (Japanese Patent Application (OPI) No. 16124/81 and U.S. Pat. No. 4,094,684).

When the silver halide is used alone in this invention without using an organic silver salt oxidizing agent, it is preferred to use silver chloroiodide, silver iodobromide, and silver chloroiodobromide which show an X-ray pattern of silver iodide crystals.

Silver iodobromide having the above property can be obtained, for example, by adding a solution of silver nitrate to a solution of potassium bromide to prepare silver bromide grains, and further adding potassium iodide.

In the step of forming the silver halide grains used in this invention, ammonia, the organic thioether derivatives described in Japanese Patent Publication No. 11386/72 and the sulfur-containing compounds described in Japanese Patent Application (OPI) No. 144319/78, etc., may be used as solvents for silver halides.

The grain formation or physical ripening may be carried out in the presence of a cadmium salt, a zinc salt, a lead salt, a thallium salt, etc.

In order to improve high or low sintensity failure, a water-soluble iridium salt such as iridium (III, IV) chloride or ammonium hexachloroididate or a water-soluble rhodium salt such as rhodium chloride may be used.

After precipitate formation or physical ripening in the process of forming the silver halide emulsion, the soluble salts may be removed. For this purpose, the noodle water washing method or the sedimentation method may be employed.

The silver halide emulsion may be used without after-ripening, but usually it is used after chemical sensitization. The sulfur sensitizing method, the reduction sensitizing method, and noble metal sensitizing method, which are known with regard to emulsions for ordinary photographic materials, may be used, singly or in combination. These chemical sensitization methods may be carried out in the presence of a nitrogen-containing heterocyclic compound (Japanese Patent Application (OPI) Nos. 126526/83 and 215644/83).

The silver halide emulsion used in this invention may be of a surface latent image type in which the latent image is formed mainly on the surface of the grains, or of an internal latent image type in which the latent image is formed in the interior of the grains. A direct reversal emulsion comprising the internal latent image-type emulsion and a nucleus-forming agent may also be used. Internal latent image-type emulsions suitable for this purpose are described, for example, in U.S. Pat. Nos. 2,592,250 and 3,761,276, Japanese Patent Publication No. 3534/83 and Japanese Patent Application (OPI) No. 136641/82. Nucleus-forming agents preferred for combination with these emulsions in this invention are described, for example, in U.S. Pat. Nos. 3,227,552, 4,245,037, 4,255,511, 4,266,031 and 4,276,364, and West German OLS No. 2,635,316.

The amount of the photosensitive silver halide to be coated is generally in the range of from 1 mg to 10 $g/m^2$ as silver.

In the present invention, an organic metal salt relatively stable to light may be used as an oxidizing agent together with the photosensitive silver halide. In this case, the photosensitive silver halide should be in contact with, or close to, the organic metal salt. Of these organic metal salts, organic silver salts are especially preferred. When such an organic metal salt is used together and the heat-developable materials is heated to a temperature above 80° C., preferably above 100° C., the organic metal salt oxidizer is also believed to participate in oxidation-reduction using the latent image of silver halide as a catalyst.

Examples of organic compounds which can be used to form the organic silver salt oxidizer include aliphatic or aromatic carboxylic acids, thiocarbonyl group-containing compounds having a mercapto group or $\alpha$-hydrogen, and imino group-containing compounds.

Typical examples of silver salts of the aliphatic carboxylic acids are silver salts derived from behenic acid, stearic acid, oleic acid, lauric acid, caprylic acid, myristic acid, palmitic acid, maleic acid, fumaric acid, tartaric acid, furoin acid, linoleic acid, linolenic acid, oleic acid, adipic acid, sebasic acid, succinic acid, acetic acid, butyric acid, and camphoric acid. Silver salts derived from halogen- or hydroxyl-substitution products of these aliphatic carboxylic acids or aliphatic carboxylic acids having a thioether group may also be used. Examples of silver salts of the aromatic carboxylic acids and other carboxyl-containing compounds typically include silver salts derived from benzoic acid, 3,5-dihydroxybenzoic acid, o-, m-, or p-methylbenzoic acid, 2,4-dichlorbenzoic acid, acetamidobenzoic acid, p-phenylbenzoic acid, gallic acid, tannic acid, phthalic acid, terephthalic acid, salicyclic acid, phenylacetic acid, pyromellitic acid and 3-carboxymethyl-4-methyl-4-thiazoline-2-thione. Examples of silver salts of the compounds having a mercapto group or a thiocarbonyl group include silver salts derived from 3-mercapto-4-phenyl-1,2,4-triazole, 2-mercaptobenzimidazole, 2-mercapto-5-aminothiadiazole, 2-mercaptobenzothiazole, S-alkylthioglycollic acid with the alkyl group having 12 to 22 carbon atoms, dithiocarboxylic acids such as dithioacetic acid, thioamides such as thiostearamide, 5-carboxy-1-methyl-2-phenyl-4-thiopyridine, mercaptotriazine, 2-mercaptobenzoxazole, mercaptooxadiazole, 3-amino-5-benzylthio-1,2,4-triazole, which are described in U.S. Pat. No. 4,123,274.

Examples of silver salts of the compounds having an imino group typically include silver salts derived from the benzotriazole or its derivatives described in Japanese Patent Publication Nos. 30270/69 or 18416/70, for example, alkyl-substituted benzotriazoles such as benzotriazole or methylbenzotriazole, halogen-substituted benzotriazoles such as 5-chlorobenzotriazole, and carboimidobenzotriazoles such as butylcarboimidobenzotriazole; the nitrobenzotriazoles described in Japanese Patent Application (OPI) No. 118639/83; the sulfobenzotriazole, carboxybenzotriazole or salts thereof, and hydroxybenzotriazole described in Japanese Patent Application (OPI) Nos. 118638/83; and 1,2,4-triazole, 1H-tetrazole, carbazole, saccharin, imidazole, and derivatives thereof as described in U.S. Pat. No. 4,220,709.

The silver salts described in *Research Disclosure,* RD No. 17029 (June 1978), organic metal salts other than the silver salts (such as copper stearate), and silver salts of alkyl group-containing carboxylic acids such as phenylpropionic acid described in Japanese Patent Application No. 221535/83 can also be used in this invention.

The above organic silver salt may be used in an amount of from 0.01 to 10 moles, and preferably from 0.01 to 1 mole, per mole of the photosensitive silver halide. A suitable total amount of the silver halide and the organic silver salt is from 50 mg to 10 $g/m^2$.

The silver halide used in this invention may be spectrally sensitized with methine dyes and other dyes. Useful dyes include, for example, cyanine dyes, merocyanine dyes, complex cyanine dyes, complex merocyanine dyes, holopolar cyanine dyes, hemicyanine dyes, styryl dyes, and hemioxonol dyes. Especially useful dyes belong to the cyanine dyes, merocyanine dyes and complex merocyanine dyes. A basic heterocyclic nuclei normally utilized in cyanine dyes are applicable to these dyes. Examples include pyrroline, oxazoline, thiazoline, pyrrole, oxazole, thioazole, selenazole, imidazole, tetrazole, and pyridine nuclei; nuclei resulting from fusing of alicyclic hydrocarbon rings with these nuclei; and nuclei resulting from fusing of aromatic hydrocarbon rings with these nuclei, such as indolenine, benzoindolenine, indole, benzoxazole, naphthoxazole, benzothiazole, naphthothiazole, benzoselenazole, benzimidazole, and quinoline nuclei. These nuclei may be substituted on carbon atoms.

Five-membered or six-membered heterocyclic nuclei such as pyrazolin-5-one, thiohydantoin, 2-thiaoxazolidine-2,4-dione, thiazolidine-2,4-dione, rhodanine, and thiobarbituric acid nuclei can be applied as nuclei having a ketomethylene structure to the merocyanine dyes or complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The emulsion may contain a dye having no spectral sensitizing action itself or a substance which does not substantially absorb visible light and has the ability to perform supersensitization. Examples include aminostyryl compounds substituted by a nitrogen-containing heterocyclic group (such as those described in U.S. Pat. Nos. 2,933,390 and 3,635,721), aromatic organic acid/-formaldehyde condensates (such as those described in U.S. Pat. No. 3,743,510), cadmium salts and azaindene compounds. The combinations described in U.S. Pat. Nos. 3,615,613, 3,615,641, 3,617,295 and 3,635,721 are especially useful.

To include these sensitizing dyes in the silver halide photographic emulsion, they may be dispersed in the emulsion directly, or as a solution in a solvent such as water, methanol, ethanol, acetone and methyl Cellosolve either singly or as a mixture. Alternatively, it is possible to dissolve such a sensitizing dye in a substantially water immiscible solvent such as phenoxyethane, disperse the solution in water or a hydrophilic colloid, and add the dispersion to the emulsion. Also, the sensitizing dye may be mixed with an oleophilic compound such as a dye donating compound and added to the emulsion together. In dissolving the sensitizing dyes to be used in combination, they may be separately dissolved, or a mixture thereof may be dissolved. They may be added at one time as a mixture to the emulsion, or may be added separately. They may be added simultaneously with the addition of other additives. The time of adding the sensitizing dyes to the emulsion may be before, during, or after chemical ripening. Or in accordance with U.S. Pat. Nos. 4,183,756 and 4,225,666, the time of addition may be before or after forming nuclei of silver halide grains.

The amount of the sensitizing dyes added is generally from about $10^{-8}$ to $10^{-2}$ mole per mole of silver halide.

In the present invention, the photographic material contains a dye donating substance (dye providing redox compound) which, when the photosensitive silver halide is reduced to silver at high temperatures, forms or releases a mobile dye corresponding to, or inversely corresponding to, this reduction reaction.

The dye providing redox compound is further described below.

A coupler capable of reacting with the developing agent can first be cited as an example of the dye providing redox compound that can be used in this invention. According to the method utilizing couplers, an oxidation product of the developing agent formed by the oxidation-reduction reaction of the silver salt with the developing agent reacts with the coupler to form a dye. It is extensively described in the literature. Specific examples of the developing agent and the coupler are described in detail, for example, in T. H. James, *The Theory of the Photographic Process,* 4th edition, pages 291–334 and 354–361, and Shinichi Kikuchi, *Shashin Kagaku* (Photographic Chemistry), 4th edition, pages 282–295 (published by Kyoritsu Shuppan K.K.).

Dye silver compounds obtained by combining organic silver salts with dyes can also be cited as examples of the dye providing redox compound. Specific examples of the dye silver compounds are described, for example, in *Research Disclosure,* RD No. 16966, May 1978, pages 54–58.

Azo dyes used for the heat-development silver dye bleaching process can also be cited as examples of the dye providing redox compound. Specific examples of the azo dyes and the method of bleaching are described, for example, in U.S. Pat. No. 4,235,957, and *Research Disclosure,* RD No. 14433, April 1976, pages 30–32.

The leuco dyes described in U.S. Pat. Nos. 3,985,565 and 4,022,617 are also cited as examples of the dye providing redox compound.

Another example of the dye providing redox compound includes compounds having the function of releasing or diffusing a diffusible dye imagewise which is used in the process described in European Patent No. 76,992.

Compounds of this type can be represented by formula (LI)

$$(\text{Dye-X})_n\text{Y} \qquad \text{(LI)}$$

wherein Dye represents a dye group or a dye precursor group, X represents a bond or a linking group, and Y represents a group having the property of causing a difference in the diffusibility of the compound of the formula $(\text{Dye-X})_n\text{-Y}$, or the property which releases a dye and cause a difference in diffusibility between the released dye and the compound $(\text{Dye-X})_n\text{-Y}$, correspondingly to or inversely correspondingly to the photosensitive silver salt having a latent image imagewise, and n represents 1 or 2, and when n is 2, the two Dye-X moieties may be identical or different.

Specific examples of dye providing redox compound represented by formula (LI) include dye developing agents resulting from linking of hydroquinone-type developing agents and dye components, which are described, for example, in U.S. Pat. Nos. 3,134,764, 3,362,819, 3,597,200, 3,544,545, and 3,482,972; the substances releasing diffusible dyes by intromolecular nucleophilic substitution reaction which are described, for example, in Japanese Patent Application (OPI) No. 63618/76; and substances releasing diffusible dyes by the intramolecular reaction of the isoxazolone ring described, for example, in Japanese Patent Application (OPI) No. 111628/74. According to methods using these dye providing redox compounds, a diffusible dye is released or diffused in a part where development has not taken place, and the dye is neither released nor diffused in a part where development has taken place.

Furthermore, since according to these methods, the development and the releasing or diffusion of dyes take place at the same time, it is very difficult to obtain an image having a high S/N (signal/noise) ratio. To remove this defect, a method has been devised which comprises converting the dye-releasing compound into an oxidation product having no ability to release dyes, causing it to be present together with a reducing agent or its precursor, and reducing the oxidation product after development with the reducing agent remaining unoxidized, to thereby release a diffusible dye. Specific examples of the dye providing redox compound used in this method are described in Japanese Patent Application (OPI) Nos. 110827/78, 130927/79, 164342/81, and 35533/78.

On the other hand, as the substance which releases a diffusible dye in the part where development has taken place, substances which release diffusible dyes by the reaction of a coupler having a diffusible dye as a leaving group with an oxidation product of the developing agent are described, for example, in British Patent No. 1,330,524, Japanese Patent Publication No. 39165/73 and U.S. Pat. No. 3,443,940, and substances which form diffusible dyes by the reaction of a coupler having a diffusion-resistant group as a leaving group with an oxidation product of the developing agent are described, for example, in U.S. Pat. No. 3,227,550.

With methods involving using these color developers, the staining of the image by the oxidative decomposition products of the developing agents gives rise to a serious problem. In order to solve this problem, dye releasing compounds having reducibility themselves and requiring no developing agents have been developed. Typical examples are shown below together with literature references describing them. Definitions of the symbols in the generic formulae are described in detail in the referennces indicated.

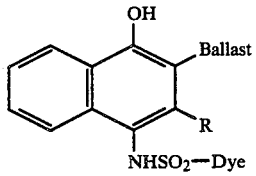

U.S. Pat. No. 3,928,312

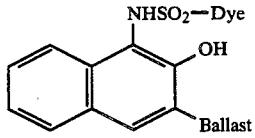

U.S. Pat. No. 4,053,312

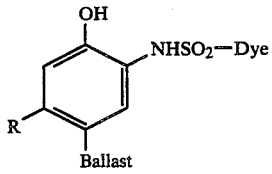

U.S. Pat. No. 4,055,428

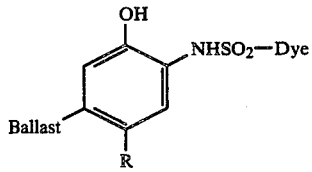

U.S. Pat. No. 4,336,322

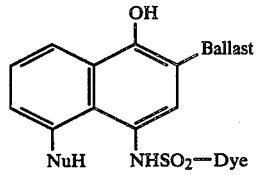

Japanese Patent Application (OPI) No. 65839/84

-continued

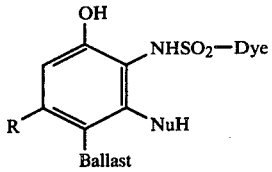

Japanese Patent Application (OPI) No. 69839/84

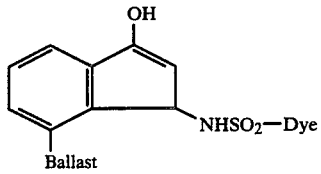

Japanese Patent Application (OPI) No. 3819/78

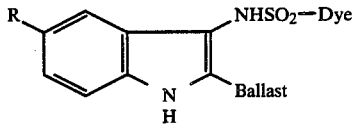

Japanese Patent Application (OPI) No. 104343/76

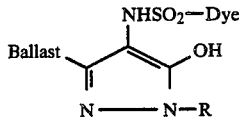

Japanese Patent Application (OPI) No. 104343/76

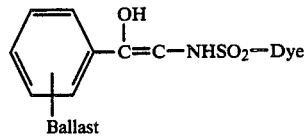

Japanese Patent Application (OPI) No. 104343/76

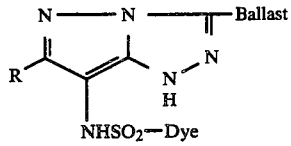

Research Disclosure, RD No. 17465, Oct. 1978

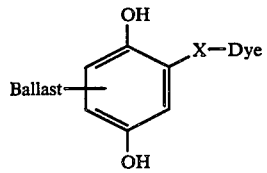

U.S. Pat. No. 3,725,062

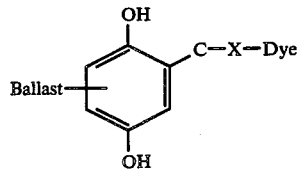

U.S. Pat. No. 3,728,113

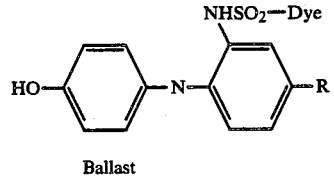

-continued

U.S. Pat. No. 3,443,939

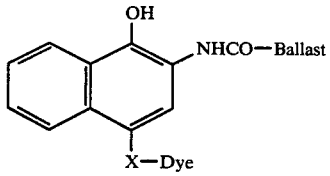

Japanese Patent Application (OPI) No. 116537/83

Any of the foregoing various dyes providing redox compound can be used in the present invention.

General examples of image-forming substances used in this invention are described in the patent documents cited above. Some specific examples are shown below. For example, the following compounds may be cited as the dye providing redox compounds represented by formula (LI).

LI-1

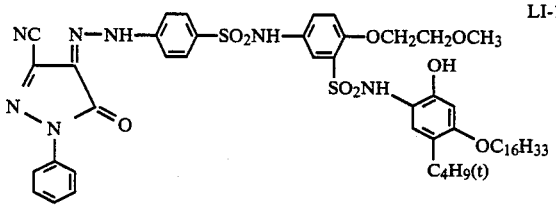

LI-2

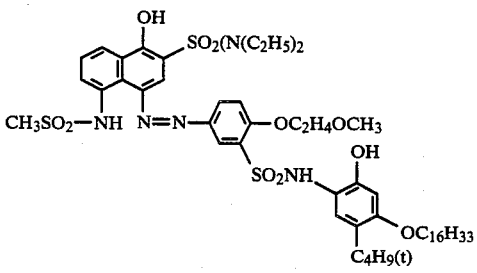

LI-3

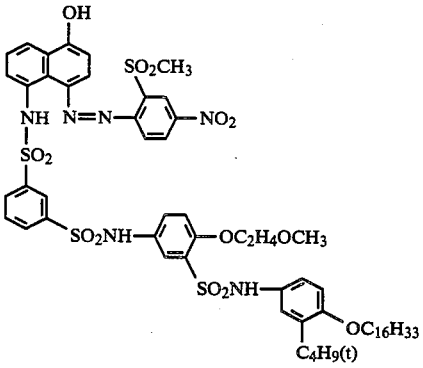

LI-4

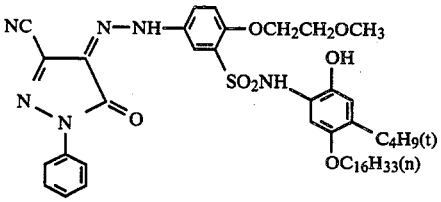

-continued

LI-5

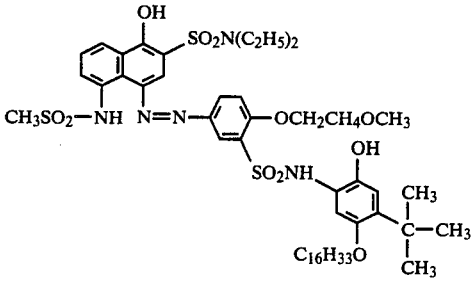

LI-6

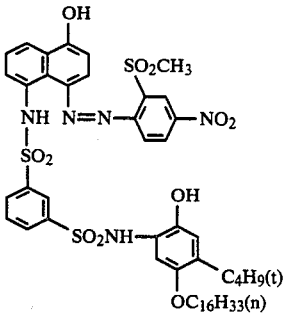

LI-7

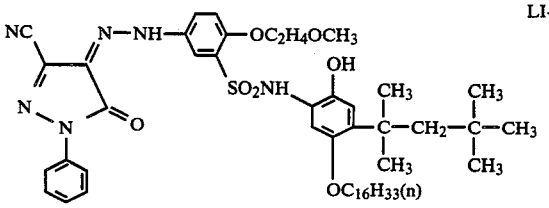

LI-8

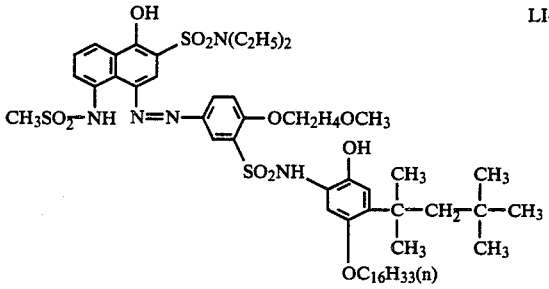

LI-9

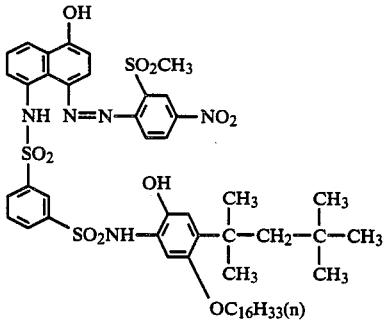

LI-10

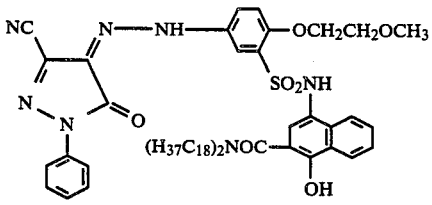

-continued

LI-11

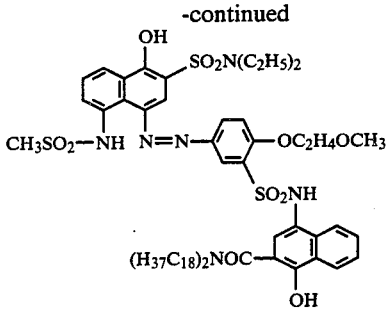

LI-12

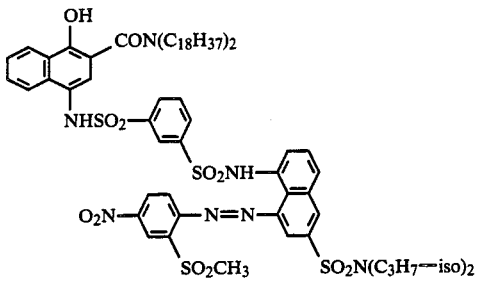

LI-13

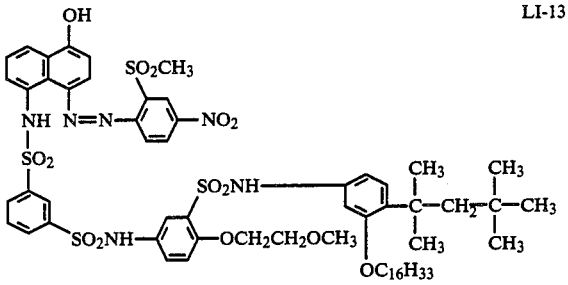

L-14

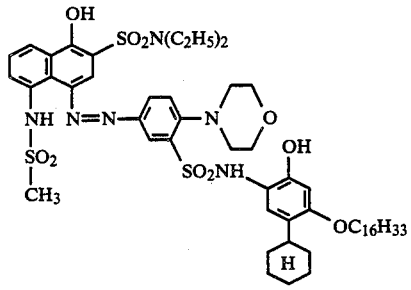

LI-15

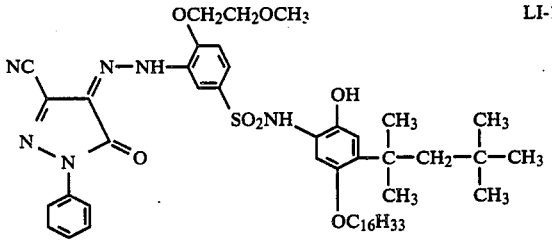

The above compounds are some examples taken among many compounds falling within the above general formula, and the present invention is not limited thereto.

The above-described dye providing redox compound and the below-described hydrophobic additives such as image-forming accelerators which can be used in the present invention can be introduced into a layer of the light-sensitive material by known method such as the method as described in U.S. Pat. No. 2,322,027. In this case, an organic solvent having a high boiling point as described in Japanese Patent Application (OPI) Nos. 83154/84, 178451/84, 178452/84, 178453/84, 178454/84, 178455/84, 178457/84, etc can be used, if necessary, together with an organic solvent having a low boiling point of 50° C. to 160° C.

The preferred amount of the high boiling point organic solvent used in the present invention is not more than 10 g, more preferably not more than 5 g, based on 1 g of the dye providing redox compound.

Further, it is possible to use a dispersion method using a polymer as described in Japanese Patent Publication No. 39853/76 and Japanese Patent Application (OPI) No. 59943/76.

In the case of using the substantially water-insoluble compounds, it is also possible other than the above-described methods to dispersedly introduce the compounds in the form of a fine particle into a binder.

Moreover, various surface active agents can be used when the hydrophobic substances are dispersed in a hydrophilic colloid. For this purpose, the surface active agents illustrated in Japanese Patent Application (OPI) No. 157636/84, pages 37 to 38 can be used.

In the present invention, if necessary, a reducing agent may be used. The reducing agent used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

A coating amount of the binder is preferably 20 g/m$^2$ or less, more preferably 10 g/m$^2$ or less, most preferably 7 g/m$^2$ or less.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat-developable photosensitive material used, processing conditions, desired images and various other factors, generally ranges from about 0.001 to 0.1 mol per mol of silver in the photosensitive material.

In the present invention, it is particularly preferred to use various bases or base precursors as dye releasing assistants.

The bases or precursors thereof can be used in a light-sensitive material and/or a dye fixing material. In the case of incorporating them in a light-sensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or organic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_3NH_2$, $H_2NC_5H_{10}NH_2$, $Me_2NC_2H_4NMe_2$, $Me_2NC_3H_6HMe_2$,

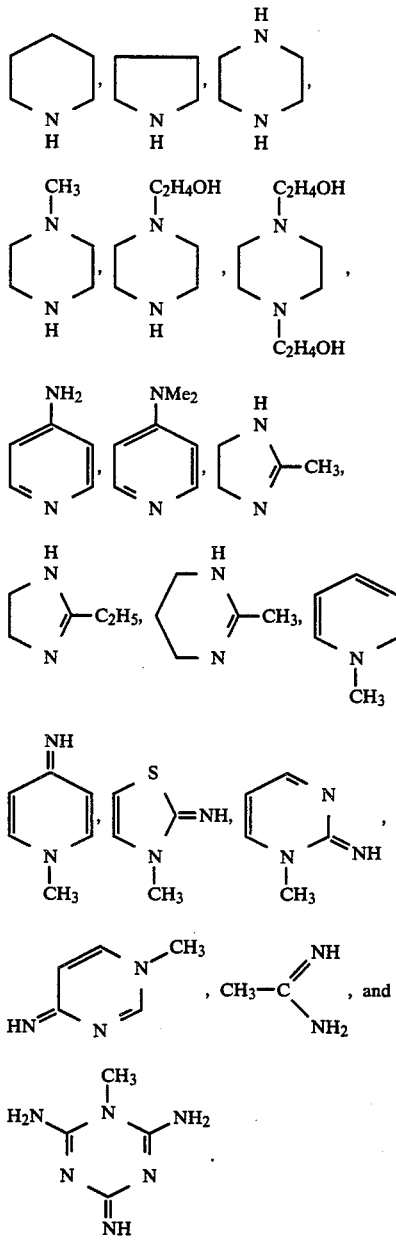

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Patent No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc., are effective.

Further, amineimides as described in *Research Disclosure,* No. 15776 (May 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the light-sensitive material, and, preferably, a range of from 0.01% by weight to 40% by weight.

The above described bases or base precursors can be used not only for the acceleration of dye release but also for other purposes such as the control of a pH value.

The above-described various ingredients to constitute a heat-developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat-developable photosensitive material can be reduced. Therefore, such distribution of additives is of advantage to some cases.

The heat-developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat-developable color photographic material is exposed to light, the resulting latent image can be developed by heating the whole material to a suitably elevated temperatures. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and antiirradiation dyes, hardeners, mordants and so on, are those described in U.S. Pat. Nos. 4,500,626, 4,478,927, 4,463,079, and Japanese Patent Application No. 28928/83 (corresponding to U.S. patent application Ser. No. 582,655, filed on Feb. 23, 1984) and U.S. Pat. No. 4,503,137. Methods for the exposure and so on cited in the above described patents can be employed in the present invention also.

The present invention is described in greater detail with reference to the following examples, although the invention is not to be construed as being limited thereto. Unless otherwise indicated, all parts, percents and ratios are by weight.

EXAMPLE 1

Preparation of a silver iodobromide emulsion:

Gelatin (40 g) and 26 g of KBr were dissolved in 3000 ml of water. The solution was maintained at 50° C. and stirred. A solution of 34 g of silver nitrate in 200 ml of water was added to the above solution over the course of 10 minutes. A solution of 3.3 g of KI in 100 ml of water was added to the mixed solution over the course of 2 minutes. The pH of the resulting silver iodobromide emulsion was adjusted to sediment and remove the excess salt. The pH of the emulsion was then adjusted to 6.0 to give 400 g of a silver iodobromide emulsion.

Preparation of silver benzotriazole emulsion:

Gelatin (28 g) and 13.2 g of benzotriazole were dissolved in 3000 ml of water. The solution was maintained at 40° C., and stirred. A solution of 17 g of silver nitrate in 100 ml of water was added to the solution over the course of 2 minutes. The pH of the resulting benzotriazole silver emulsion was adjusted to sediment and remove the excess salt. The pH of the emulsion was then adjusted to 6.0 to give 400 g of a silver benzotriazole emulsion.

Preparation of a gelatin dispersion of a dye providing redox compound (means the same as the aforesaid image-forming substance; the same applies hereinafter):

Five grams of the dye providing redox compound (1) shown below, 0.5 g of 2-ethyl-hexylsuccinate-sodium sulfonate as a surface-active agent, and 5 g of tricresyl phosphate (TCP) were weighed, and 30 ml of ethyl acetate was added. The mixture was heated to about 60° C. to form a solution. The solution was mixed with 100 g of a 10% gelatin solution with stirring. The mixture was dispersed by a homogenizer for 10 minutes at 10,000 rpm. The resulting dispersion is referred to as the dispersion of a dye providing redox compound.

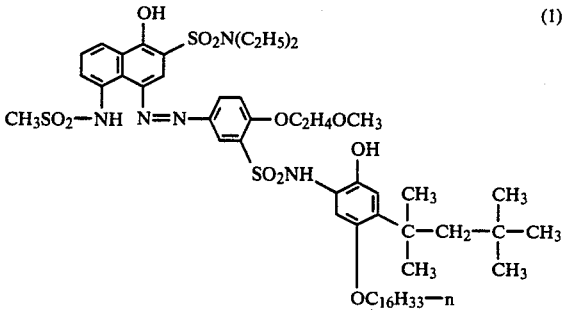

(1)

Preparation of a gelatin dispersion of the compound of this invention:

Three grams of compound (4) of this invention was added to 100 g of a 1% aqueous solution of gelatin, and the mixture was pulverized for 10 minutes in a mill containing 100 g of glass beads having an average particle diameter of about 0.6 mm. The glass beads were separated by filtration to give a gelatin dispersion of the compound (4) of this invention.

Preparation of photographic materials A and B:

A photographic material A was prepared as follows:

| | | |
|---|---|---|
| (a) | Silver iodobromide emulsion | 20 g |
| (b) | Silver benzotriazole emulsion | 10 g |
| (c) | Dispersion of the dye providing redox compound | 33 g |
| (d) | A 5% aqueous solution of a compound of the following formula | 10 ml |
| | 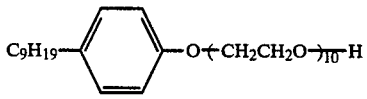 | |
| (e) | A 10% aqueous solution of a compound of the formula $N_2NSO_2N(CH_3)_2$ | 4 ml |
| (f) | A solution of 1.6 g of guanidine trichloroacetate as a base precursor in 16 ml of ethanol | |
| (g) | The gelatin dispersion of compound (4) of the invention | |

The ingredients (a) to (g) were mixed and heated to form a solution. The solution was coated on a 180 μm thick polyethylene terephthalate film at a wet film thickness of 33 μm, and dried.

As a protective layer, a mixture of 30 ml of a 10% aqueous solution of gelatin and 70 ml of water was coated on the resulting coated layer to a wet film thickness of 30 μm, and dried to give a photographic material A.

A photographic material B was prepared as follows:

| | | |
|---|---|---|
| (a) | Silver iodobromide emulsion | 20 g |
| (b) | Silver benzotriazole emulsion | 10 g |
| (c) | Dispersion of the dye providing redox compound | 33 g |
| (d) | A 5% aqueous solution of a compound of the following formula | 10 ml |
| | 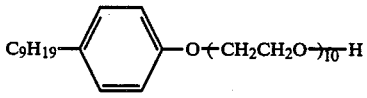 | |
| (e) | A 10% aqueous solution of a compound | 4 ml |

-continued

| | | |
|---|---|---|
| | of the formula $H_2NSO_2N(CH_3)_2$ | |
| (f) | A solution of 1.6 g of guanidine trichloroacetate as a base precursor in 16 ml of ethanol | |
| (g) | Water | 10 ml |

The ingredients (a) to (g) were mixed and heated to form a solution. The solution was coated on a 180 μm thick polyethylene terephthalate film to a wet film thickness of 33 μm. The same protective layer as in the preparation of the photographic material A was coated on the resulting coated layer.

An image-receiving material having an image-receiving layer was prepared as follows:

First, 0.75 g of a gelatin hardener H-1, 0.25 g of a gelatin hardener H-2, 160 ml of water and 100 g of 10% lime-processed gelatin were uniformly mixed. The mixture was coated uniformly to a wet film thickness of 60 μm on a paper support on which polyethylene having titanium oxide dispersed in it had been laminated, and then dried. The gelatin hardener H-1 had the following structure:

$$CH_2{=}CHSO_2CH_2CONHCH_2CH_2NHCOCH_2.SO_2CH{=}CH_2$$

The gelatin hardener H-2 had the following structure:

$$CH_2{=}CHSO_2CH_2CONHCH_2.CH_2CH_2NHCOCH_2SO_2CH{=}CH_2$$

Fifteen grams of a polymer of the following structure was dissolved in 200 ml of water, and uniformly mixed with 100 g of 10% lime-processed gelatin. The mixture was uniformly coated on the above coated layer to a wet thickness of 85 μm, and dried to form a dye fixing material.

Polymer

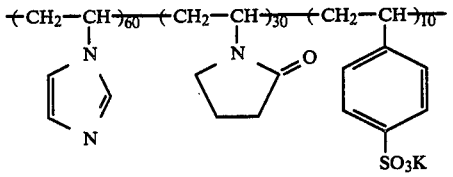

Each of the photographic materials A and B was exposed (step-wedge exposure) imagewise for 10 seconds at 2000 lux using a tungsten-filament lamp, and uniformly heated for 30 seconds on a heat block heated at 140° C. or 143° C.

The image-receiving material was dipped in water, and then the heated photographic material A or B was laid over it so that the coated surfaces contacted each other.

The assembly was heated for 6 seconds on a heat block at 80° C., and the image-receiving material was peeled off from the photographic material. A negative magenta color image was obtained on the image-receiving material. The density of the negative image was measured by a MacBeth reflection densitometer (RD-519). The following results were obtained.

| Photographic Material | Heated at 140° C. for 30 seconds | | Heated at 143° C. for 30 seconds | |
|---|---|---|---|---|
| | Maximum Density | Minimum Density | Maximum Density | Minimum Density |
| A (invention) | 2.10 | 0.13 | 2.14 | 0.19 |
| B (comparison) | 2.15 | 0.15 | 2.19 | 0.28 |

The above results show that as a result of using the compound of this invention, even when the developing temperature was increased by 3° C., both the maximum and minimum densities of the resulting image increased little. On the other hand, in the comparative material, the fog density increased significantly. It can therefore be seen that the compound of this invention has a great temperature compensating effect.

EXAMPLE 2

Photographic materials C to G were prepared and processed in the same way as in Example 1, except that the following compounds were used instead of compound (4) of the invention in the preparation of the photographic material A in Example 1. The results obtained are also tabulated.

| Sample | Compound | Heated at 140° C. for 30 seconds | | Heated at 143° C. for 30 seconds | |
|---|---|---|---|---|---|
| | | Maximum | Minimum | Maximum | Minimum |
| C | (3) | 2.14 | 0.11 | 2.17 | 0.17 |
| D | (15) | 2.08 | 0.11 | 2.10 | 0.18 |
| E | (18) | 2.04 | 0.12 | 2.09 | 0.20 |
| F | (20) | 2.11 | 0.15 | 2.15 | 0.18 |
| G | (24) | 2.13 | 0.14 | 2.15 | 0.21 |

The above results show that the compounds of this invention have an excellent temperature compensating effect.

EXAMPLE 3

This example illustrates the use of the compound of this invention in a multilayered photographic material.

Preparation of photographic material H:

Five grams of a yellow dye providing redox substance (2) shown below, 0.5 g of 2-ethylhexylsuccinate-sodium sulfonate as a surface-active agent, and 10 g of triisononyl phosphate were weighed, and 30 ml of ethyl acetate was added. The mixture was heated to about 60° C. to form a uniform solution. The solution was mixed with 100 g of a 10% solution of lime-processed gelatin with stirring, and the mixture was dispersed by a homogenizer for 10 minutes at 10,000 rpm. The resulting dispersion is referred to as a dispersion of a yellow dye providing redox substance.

A dispersion of a magenta dye providing redox substance was prepared in the same way as above except that the magenta dye providing redox substance (1) (described in Example 1) was used. Likewise, a dispersion of a cyan dye providing redox substance (3) shown below was prepared.

From the above materials, a color photosensitive material of a multilayer structure as described in the following table was prepared.

(2)

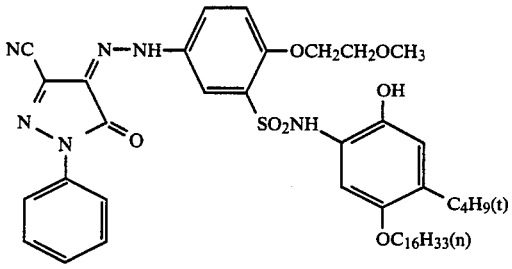

(3)

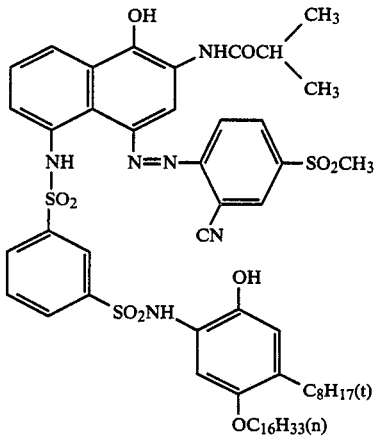

Photographic material H

6th Layer

Gelatin (coated amount: 1,000 mg/m$^2$),
Guanidine trichloroacetate (coated amount: 190 mg/m$^2$),
Compound (4) of this invention (coated amount: 10 mg/m$^2$).

5th Layer (blue-sensitive emulsion layer)

Silver iodobromide emulsion prepared as in Example 1 (iodine 10 mole %; coated amount: 400 mg/m$^2$ as Ag),
Dimethylsulfamide (coated amount: 180 mg/m$^2$),
Guanidine trichloroacetate (coated amount: 440 mg/m$^2$),
Compound (4) of the invention (coated amount: 5 mg/m$^2$), -continued

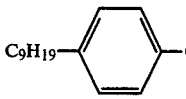

100 mg/m$^2$).

4th Layer (interlayer)

Gelatin (coated amount: 1,200 mg/m$^2$),
Guanidine trichloroacetate (coated amount: 190 mg/m$^2$),
Compound (4) of the invention (coated amount: 10 mg/m$^2$).

3rd Layer (green-sensitive emulsion layer)

Silver iodobromide emulsion prepared as in Example 1 (iodine 10 mole %; coated amount: 400 mg/m$^2$ as Ag),
Dimethylsulfamide (coated amount: 180 mg/m$^2$),
Sensitizing dye (D-1) (coated amount: $10^{-6}$ mole/m$^2$),
Guanidine trichloroacetate (coated amount: 440 mg/m$^2$),
Compound (4) of this invention (coated amount: 5 mg/m$^2$),
Magenta dye providing redox substance (1) (coated amount: 400 mg/m$^2$),
Gelatin (coated amount: 1,000 mg/m$^2$),
High-boiling solvent (same as used in the 5th layer; coated amount: 800 mg/m$^2$),
Surfactant (same as used in the 5th layer; coated amount: 100 mg/m$^2$).

2nd Layer (interlayer)

Gelatin (coated amount: 1,000 mg/m$^2$),
Guanidine trichloroacetate (coated amount: 198 mg/m$^2$),
Compound (4) of the invention (coated amount: 10 mg/m$^2$).

1st Layer (red-sensitive emulsion layer)

Silver iodobromide emulsion prepared as in Example 1 (iodine 10 mole %; coated amount: 400 mg/m$^2$ as Ag),
Benzenesulfonamide (coated amount: 180 mg/m$^2$),
Sensitizing dye (D-2) (coated amount: $8 \times 10^{-7}$ mole/m$^2$),
Guanidine trichloroacetate (coated amount: 440 mg/m$^2$),
Compound (4) of the invention (coated amount: 5 mg/m$^2$),
Cyan dye donating substance (3) (coated amount: 300 mg/m$^2$),
Gelatin (coated amount: 1,000 mg/m$^2$),
High-boiling solvent (same as used in the 5th layer; coated amount 600 mg/m$^2$),
Surfactant (same as used in the 5th layer; coated amount; 100 mg/m$^2$).

The above layers were formed on a support to prepare the photographic material H.

D-1

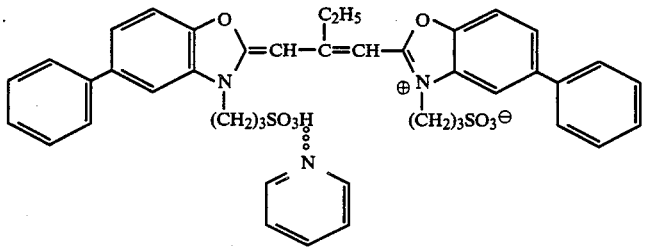

D-2

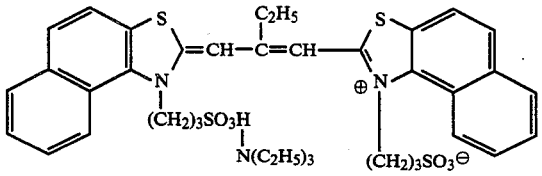

Yellow dye donating substance (2) (coated amount: 400 mg/m$^2$),
Gelatin (coated amount: 1,000 mg/m$^2$),
High-boiling solvent of the formula
(iso-$C_9H_{19}O)_3P{=}O$ (coated amount: 800 mg/m$^2$),
Surfactant of the formula The color photographic material so prepared was exposed for 10 seconds at 2000 lux through B (blue), G (green), and R (red) color separation filters having a continuouly changing density using a tungsten-filament lamp.

The photographic material was then processed in the same way as in Example 1. The results are tabulated below.

| Color Separation Filter | Photographic material H: Heated at 140° C. for 30 seconds, Maximum Density | Heated at 140° C. for 30 seconds, Minimum Density | Heated at 143° C. for 30 seconds, Maximum Density | Heated at 143° C. for 30 seconds, Minimum Density |
|---|---|---|---|---|
| B | 1.80 | 0.20 | 1.85 | 0.23 |
| G | 2.09 | 0.19 | 2.12 | 0.22 |
| R | 2.20 | 0.21 | 2.24 | 0.25 |

The above results show that the compound of this invention has an excellent temperature compensating effect.

EXAMPLE 4

Preparation of a silver halide emulsion for a 5th layer:

One thousand milliliters of an aqueous containing potassium iodide and potassium bromide and an aqueous solution of 1 mole of silver nitrate in 1,000 ml of water were simultaneously added to a well stirred aqueous gelatin solution (prepared by dissolving 20 g of gelatin and ammonia in 1,000 ml of water kept at 50° C.) while maintaining a constant pAg value. As a result, a monodisperse octahedral silver iodobromide (iodine 5 mole%) having an average grain size of 0.5 micron was prepared.

After washing with water and removing the excess salt, 5 mg of chloroauric acid (tetrahydrate) and 2 mg of sodium thiosulfate were added, and the emulsion was subjected to gold and sulfur sensitization at 60° C. The amount of the emulsion obtained was 1.0 kg.

Preparation of an emulsion for a third layer:

Six hundred milliliters of an aqueous solution containing sodium chloride and potassium bromide, an aqueous solution of 0.59 mole of silver nitrate in 600 ml of water, and the following dye solution (I) were added simultaneously over the course of 40 minutes at equal rates to a well stirred aqueous solution of gelatin (prepared by dissolving 20 g of gelatin and 3 g of sodium chloride in 1,000 ml of water and kept at 75° C.). As a result, a monodisperse cubic silver chlorobromide emulsion (bromine 80 mole%) having an average grain size of 0.35 micron on which the dye was adsorbed was prepared.

After washing with water and removing the excess salt, 5 mg of sodium thiosulfate and 20 mg of 4-hydroxy-6-methyl-1,3,3a,7-tetrazaindene were added to sensitize the emulsion chemically at 60° C. The amount of the emulsion yielded was 600 g.

Dye Solution (I)

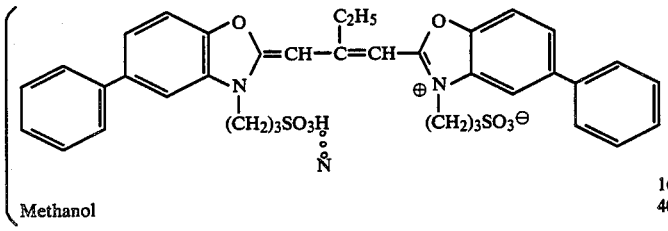

Methanol 160 mg 400 ml

Preparation of an emulsion for a first layer:

Six hundred milliliters of an aqueous solution containing sodium chloride and potassium bromide and an aqueous solution of 0.59 mole of silver nitrate in 600 ml of water were simultaneously added at equal rates to a well stirred aqueous gelatin solution (prepared by dissolving 20 g of gelatin and 3 g of sodium chloride in 1,000 ml of water and kept at 75° C.) over the course of 40 minutes. As a result, a monodisperse cubic silver chlorobromide emulsion (bromine 80 mole%) having an average grain size of 0.35 micron was prepared.

After washing with water and removing the excess salt, 5 mg of sodium thiosulfate and 20 mg of 4-hydroxy-6-methyl-1,3,3a,7-tetrazaindene were added to sensitize it chemically at 60° C. The amount of the emulsion yielded was 600 g.

The silver benzotriazole emulsion shown below was prepared in the same way as in Example 1.

Photographic material I

6th Layer

Gelatin (coated amount: 740 mg/m$^2$),
Base precursor (A) of the formula

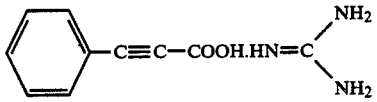

(coated amount: 160 mg/m$^2$).

5th Layer (blue-sensitive emulsion layer)

Silver iodobromide emulsion (iodine 5 mole %; coated amount: 500 mg/m$^2$ as Ag),
Dimethylsulfamide (coated amount: 160 mg/m$^2$),
Base precursor (A) (same as used in the 6th layer; coated amount: 180 mg/m$^2$),
Benzotriazole silver emulsion (coated amount: 300 mg/m$^2$ as Ag),
Yellow dye providing redox substance (2) (coated amount: 400 mg/m$^2$),
Gelatin (coated amount: 1,200 mg/m$^2$),
High-boiling solvent of the formula
(iso-$C_9H_{19}O)_3P{=}O$ (coated amount: 700 mg/m$^2$),
Surfactant of the formula

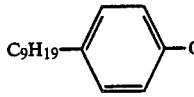

(coated amount: 70 mg/m$^2$).

4th Layer (interlayer)

Gelatin (coated amount: 700 mg/m$^2$),
Base precursor (A) (same as used in the 6th layer; coated amount: 150 mg/m$^2$).

3rd Layer (green-sensitive emulsion layer)

Silver chlorobromide emulsion (bromine 80 mole %; coated amount: 200 mg/m$^2$),
Dimethylsulfamide (coated amount: 140 mg/m$^2$),
Benzotriazole silver emulsion (coated amount: 100 mg/m$^2$ as Ag),
Base precursor (A) (same as used in the 6th layer; coated amount: 140 mg/m$^2$),
Magenta dye providing redox substance (1) (coated amount: 330 mg/m$^2$), -continued Gelatin (coated amount: 860 mg/m$^2$),
High-boiling solvent (same as used in the 5th layer; coated amount: 430 mg/m$^2$),
Surfactant (same as used in the 5th layer; coated amount: 60 mg/m$^2$).

2nd Layer (interlayer)

Gelatin (coated amount: 1,000 mg/m$^2$),
Base precursor (A) (same as used in the 6th layer; coated amount: 160 mg/m$^2$).

1st Layer (red-sensitive emulsion layer)

Silver chlorobromide emulsion (bromine 80 mole %; coated amount: 200 mg/m$^2$ as Ag),
Benzenesulfonamide (coated amount: 140 mg/m$^2$),
Sensitizing dye of the following formula

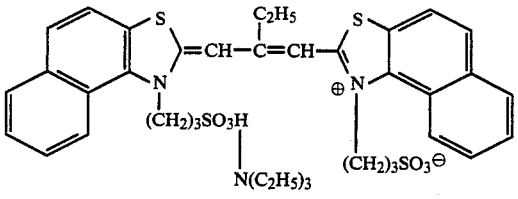

(coated amount: $8 \times 10^{-7}$ mole/m$^2$),
Silver benzotriazole emulsion (coated amount: 230 mg/m$^2$),
Base precursor (A) (same as used in the 6th layer; coated amount: 150 mg/m$^2$),
Cyan dye providing substance (3) (coated amount: 300 mg/m$^2$),
Gelatin (coated amount: 850 mg/m$^2$),
High-boiling solvent (same as used in the 5th layer; coated amount: 540 mg/m$^2$),
Surfactant (same as used in the 5th layer; coated amount: 60 mg/m$^2$).

The above layers were formed on a support to prepare the photosensitive material I.

Preparation of a dye fixing material:

Lime-processed gelatin (12 g) was dissolved in 200 ml of water, and 16 ml of a 0.5M aqueous solution of zinc acetate was added. They were uniformly mixed. The mixture was uniformly coated to a wet film thickness of 85 μm on a 100 μm-thick white film support composed of polyethylene terephthalate containing titanium dioxide. A coating solution of the following composition was prepared, and coated uniformly on the coated layer to a wet film thickness of 90 μm, and dried to prepare a dye fixing material.

| Formulation J of the coating solution for a dye fixing layer | |
|---|---|
| 10% Aqueous solution of polyvinyl alcohol (degree of polymerization: 2000) | 120 g |
| Urea | 20 g |
| N—methylurea | 20 g |
| 12% Aqueous solution of $\text{-}(CH_2\text{-}CH)_n\text{-}$ (N, N) | 80 g |
| Compound (4) of the invention (described in Example 1) | 60 ml |

| Formulation K of the coating solution for a dye fixing layer | |
|---|---|
| 10% Aqueous solution of polyvinyl alcohol (degree of polymerization: 2000) | 120 g |
| Urea | 20 g |
| N—methylurea | 20 g |
| 12% Aqueous solution of $\text{-}(CH_2\text{-}CH)_n\text{-}$ (N, N) | 80 g |
| Water | 60 ml |

The resulting color photographic material I was exposed for 1 second at 2000 lux through B, G, and R color separation filters having a continuously changing temperature by using a tungsten-filament lamp. It was then heated uniformly for 30 seconds on a heated block at 140° C.

The photographic material was laid together with the dye fixing material prepared above so that the coated surfaces contacted each other. The assembly was passed through pressure heat rollers kept at 130° C., and immediately thereafter, heated for 30 minutes on a heat block at 120° C. Immediately after heating, the dye fixing material was peeled off from the photographic material. Yellow, magenta and cyan color images corresponding to the B, G, and R color separation filters were obtained on the dye fixing material. The maximum and minimum densities of these colors were measured by a MacBeth reflection densitometer (RD 519). The results are tabulated below.

| Color Separation Filter | Dye Fixing Layer J (Invention) Maximum Density | Dye Fixing Layer J (Invention) Minimum Density | Color Fixing Layer K (Comparison) Maximum Density | Color Fixing Layer K (Comparison) Minimum Density |
|---|---|---|---|---|
| B | 1.80 | 0.20 | 1.82 | 0.26 |
| G | 2.05 | 0.22 | 2.08 | 0.31 |
| R | 2.12 | 0.13 | 2.15 | 0.25 |

The results demonstrate that the addition of the compound of this invention to the dye fixing layer is effective for inhibiting increased fogging during the transfer step.

EXAMPLE 5

Ten grams of the dye providing redox substance (4), 0.5 g of 2-ethylhexyl succinate-sodium sulfonate and 10 g of tricresyl phosphate were weighed, and 20 ml of cyclohexanone was added. The mixture was heated to 60° C. to form a uniform solution. The solution was mixed with 100 g of a 10% aqueous solution of lime-processed gelatin with stirring, and the mixture was dispersed in a homogenizer. A photosensitive material L was prepared as follows:

| | | |
|---|---|---|
| (a) | Silver iodobromide emulsion of Example 1 | 5.5 g |
| (b) | 10% Aqueous gelatin solution | 0.5 g |
| (c) | The above dispersion of the dye providing redox substance | 2.5 g |
| (d) | 10% Ethanol solution of guanidine trichloroacetate | 1 ml |
| (e) | 10% Methanol solution of 2,6-dichloro-4-aminophenol | 0.5 ml |
| (f) | 5% Aqueous solution of a compound having the following composition | 1 ml |

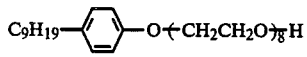

-continued

| | | |
|---|---|---|
| (g) | Gelatin dispersion of compound (4) of this invention | 0.5 ml |
| (h) | Water | 6 ml |

(4)

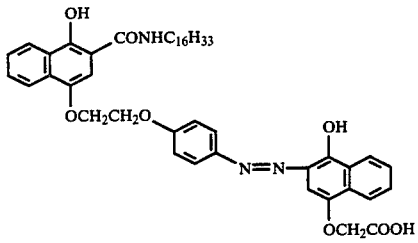

The ingredients (a) to (h) were mixed and heated to form a solution. The solution was coated to a wet film thickness of 85 μm on a polyethylene terephthalate film. As a protective layer, gelatin was coated at a rate of 1.5 g/m$^2$ on the coated layer to prepare the photographic material L.

The photographic material was exposed and processed in the same way as in Example 1, and the maximum and minimum densities of the resulting color images were measured. The results are tabulated below.

| | Heated at 140° C. for 30 seconds | | Heated at 143° C. for 30 seconds | |
|---|---|---|---|---|
| Photographic Material | Maximum Density | Minimum Density | Maximum Density | Minimum Density |
| L | 1.97 | 0.15 | 2.01 | 0.22 |

The above table suggests that the effect of the compound of this invention is also remarkable in a photographic material containing a dye providing redox substance which releases a dye by the coupling reaction with an oxidation product of the developing agent.

EXAMPLE 6

Five grams of a dye providing redox substance (5) having the following structure, 4 g of an electron donor having the following structure, 0.5 g of 2-ethylhexyl succinatesodium sulfonate, 10 g of tricresyl phosphate, and 20 ml of cyclohexanone were mixed and heated to about 60° C. to form a solution. The solution was worked up in the same way as in Example 5 to prepare a dispersion of the reducible dye providing redox substance.

Dye providing redox substance (5)

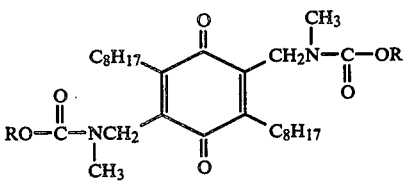

-continued

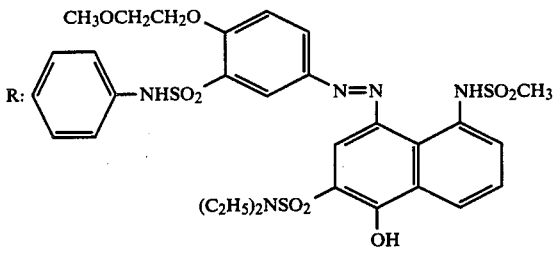

Electron donator

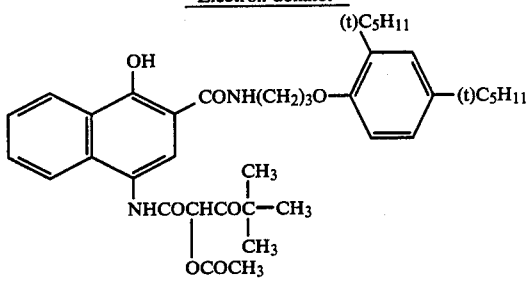

A photographic material M was prepared in the same way as in Example 5 except that the above dispersion of the reducible dye providing redox substance was used instead of the dispersion of the dye providing redox substance (4) used in the photographic material L.

The photographic material M was exposed and processed in the same way as in Example 1, and the maximum and minimum densities of the resulting images were measured. The results are tabulated below.

| | Heated at 140° C. for 30 seconds | | Heated at 143° C. for 30 seconds | |
|---|---|---|---|---|
| Photographic Material | Maximum Density | Minimum Density | Maximum Density | Minimum Density |
| M | 1.67 | 0.19 | 1.70 | 0.21 |

It can be confirmed from the above table that the compound of this invention is also effective in a photographic material containing the above reducible dye providing redox substance capable of forming a positive image with respect to a silver image.

EXAMPLE 7

Preparation of a dispersion of a coupler in gelatin:

Five grams of 2-dodecylcarbamoyl-1-naphthol, 0.5 g of 2-ethylhexyl succinate sodium sulfonate, and 2.5 g of tricresyl phosphate (TCP) were weighed, and 30 ml of ethyl acetate were added to form a solution. The solution was mixed with 100 g of a 10% solution of gelatin with stirring. The mixture was dispersed by a homogenizer at 10,000 rpm for 10 minutes.

A photographic material N was prepared in the following manner.

| | | |
|---|---|---|
| (a) | Silver iodobromide (obtained in Example 1) | 10 g |
| (b) | Gelatin dispersion of the coupler | 3.5 g |
| (c) | Solution of 0.25 g of quanidine trichloroacetate in 2.5 cc of ethanol | |
| (d) | 10% Aqueous solution of gelatin | 5 g |
| (e) | Solution of 2,6-dichloro-p-aminophenol in 15 cc of water | 0.2 g |
| (f) | Gelatin dispersion of the compound (4) of the invention (described in Example | 1 ml |

-continued

| |
|---|
| 1) |

A coating composition having the above formulation was coated to a wet film thickness of 60 μm on a polyethylene terephthalate support, and dried to prepare the photographic material N.

The photographic material N was exposed imagewise for 5 seconds at 2000 lux by using a tungsten-filament lamp, and then uniformly heated for 20 seconds on a heat block kept at 150° C. or 153° C. A negative cyan color image was obtained.

The densities of the image were measured by a MacBeth transmission-type densitometer (TD-504). The results are tabulated below.

| | Heated at 150° C. for 20 seconds | | Heated at 153° C. for 20 seconds | |
|---|---|---|---|---|
| Photographic Material | Maximum Density | Minimum Density | Maximum Density | Minimum Density |
| N | 2.12 | 0.25 | 2.16 | 0.27 |

The above results show that the compound of this invention has a great temperature compensating effect.

EXAMPLE 8

This example illustrates the incorporation of the compound of this invention in a black-and-white photographic material.

A photographic material O was prepared as follows:

| | | |
|---|---|---|
| (a) | Silver iodobromide emulsion (described in Example 1) | 1 g |
| (b) | Silver benzotriazole emulsion (described in Example 1) | 10 g |
| (c) | 10% Ethanol solution of guanidine trichloroacetate | 1 cc |
| (d) | 5% Methanol solution of a compound having the following structural formula 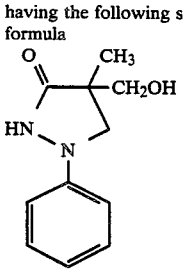 | 2 cc |
| (e) | Dispersion of compound (4) of the invention in gelatin (described in Example 1) | 1 cc |

A coating solution of the above formulation was coated to a wet film thickness of 60 μm on a polyethylene terephthalate support, and dried.

The resulting photographic material O was exposed imagewise for 5 seconds at 2000 lux by using a tungsten-filament lamp, and then heated uniformly for 30 seconds on a heat block kept at 130° C. to 133° C. A negative brown image was obtained. The densities of the image were measured by a MacBeth transmission-type densitometer (TD-504). The results are tabulated below.

| | Heated at 130° C. for 30 seconds | | Heated at 133° C. for 30 seconds | |
|---|---|---|---|---|
| Photographic Material | Maximum Density | Minimum Density | Maximum Density | Minimum Density |
| 0 | 0.78 | 0.14 | 0.82 | 0.17 |

It is also seen from the above results that the compound of this invention has a great temperature compensating effect.

While the invention has been described in detail and with reference to specific embodiments thereof, it will be apparent to one skilled in the art that various changes and modifications can be made therein without departing from the spirit and scope thereof.

What is claimed is:

1. A process for forming an image comprising a heating step wherein a silver halide light-sensitive photographic material is heated in the presence of a compound represented by formula (I)

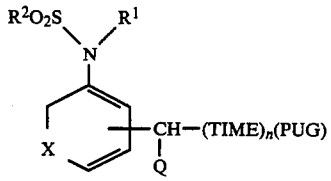

(I)

wherein X represents an atomic group completing a carbocyclic aromatic ring or a heterocyclic aromatic ring; $R^1$ is selected from groups represented by formulae (A), (B), and (C)

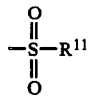

(A)

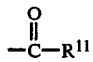

(B)

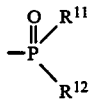

(C)

in which $R^{11}$ and $R^{12}$ each represents a substituted or unsubstituted alkyl group, a cycloalkyl group, a substituted or unsubstituted alkenyl group, an aralkyl group, a substituted or unsubstituted aryl group, a substituted or unsubstituted heterocyclic group, an alkyloxy or aryloxy group, an alkylthio or arylthio group, or a substituted or unsubstituted amino group, or $R^{11}$ and $R^{12}$ together form a 5-membered or 6-membered ring; $R^2$ represents a group selected from the groups represented by $R^{11}$; $R^1$ and $R^2$ together form a 5-membered or 6-membered ring; Q represents a hydrogen atom, an alkyl group, or an aryl group; TIME represents a timing group; PUG represents a photographically useful group; and n represents 0 or an integer, wherein the photographic material contains a base or a base precursor.

2. A process as in claim 1, wherein the heating temperature is from 80° to 250° C.

3. A process as in claim 1, wherein at least one of $R^{11}$ and $R^{12}$ represents a substituted or unsubstituted linear or branched alkyl group having from 1 to 18 carbon atoms or a 5-membered or 6-membered cycloalkyl group having from 5 to 10 carbon atoms.

4. A process as in claim 1, wherein at least one of $R^{11}$ and $R^{12}$ represents an alkenyl group selected from the group consisting of a vinyl group, an allyl group, a crotyl group, and a substituted or unsubstituted styryl group.

5. A process as in claim 1, wherein at least one of $R^{11}$ and $R^{12}$ represents an aralkyl group selected from a benzyl group and a $\beta$-phenethyl group.

6. A process as in claim 1, wherein at least one of $R^{11}$ and $R^{12}$ represents an aryl group having from 6 to 18 carbon atoms.

7. A process as in claim 1, wherein at least one of $R^{11}$ and $R^{12}$ represents a substituted or unsubstituted 5-membered or 6-membered heterocyclic group having oxygen, nitrogen, or sulfur as a hetero atom.

8. A process as in claim 1, wherein at least one of $R^{11}$ and $R^{12}$ represents an alkyloxy or an aryloxy group.

9. A process as in claim 1, wherein at least one of $R^{11}$ and $R^{12}$ represents represents an alkylthio or an arylthio group.

10. A process as in claim 1, wherein PUG represents a photographically useful reagent selected from an anti-foggant, a development restrainer, a developing agent, a development accelerator, an electron donor, a fogging agent, a nucleus-forming agent, a solvent for silver halide, a dye, a colored material for color diffusion transfer, and a coupler.

11. A process as in claim 10, wherein the photographically useful reagent is a development restrainer.

12. A process as in claim 11, wherein the development restrainer is represented by formula (II)

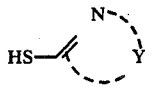

(II)

wherein Y represents an atomic group forming a 5-membered or 6-membered heterocyclic ring.

* * * * *